US009689140B2

(12) United States Patent
Baba et al.

(10) Patent No.: US 9,689,140 B2
(45) **Date of Patent: *Jun. 27, 2017**

(54) CONSTRUCTION MACHINE CONTROL SYSTEM, CONSTRUCTION MACHINE, AND CONSTRUCTION MACHINE CONTROL METHOD

(71) Applicant: Komatsu Ltd., Tokyo (JP)

(72) Inventors: Akinori Baba, Hiratsuka (JP); Katsuhiro Ikegami, Hiratsuka (JP); Takeshi Takaura, Minou (JP); Masashi Ichihara, Hiratsuka (JP); Yuki Shimano, Hirakata (JP)

(73) Assignee: Komatsu Ltd., Tokyo (JP)

( * ) Notice: Subject to any disclaimer, the term of this patent is extended or adjusted under 35 U.S.C. 154(b) by 41 days.

This patent is subject to a terminal disclaimer.

(21) Appl. No.: 14/762,960

(22) PCT Filed: Mar. 24, 2015

(86) PCT No.: PCT/JP2015/058995

§ 371 (c)(1),
(2) Date: Jul. 23, 2015

(87) PCT Pub. No.: WO2015/129930

PCT Pub. Date: Sep. 3, 2015

(65) Prior Publication Data

US 2016/0265187 A1 Sep. 15, 2016

(30) Foreign Application Priority Data

Jun. 4, 2014 (WO) ..... PCT/JP2014/064892

(51) Int. Cl.
*E02F 3/43* (2006.01)
*E02F 3/96* (2006.01)
(Continued)

(52) U.S. Cl.
CPC ..... *E02F 3/435* (2013.01); *E02F 3/425* (2013.01); *E02F 3/963* (2013.01); *E02F 9/2012* (2013.01);
(Continued)

(58) Field of Classification Search
CPC ..... E02F 9/20; E02F 9/22; E02F 3/43
(Continued)

(56) References Cited

U.S. PATENT DOCUMENTS 5,810,046 A * 9/1998 Lee ..... E02F 3/438 137/269
8,909,439 B2 * 12/2014 Matsuyama ..... E02F 3/435 37/195
(Continued)

FOREIGN PATENT DOCUMENTS

CN 1163964 A 11/1997
CN 101310114 A 11/2008
(Continued)

OTHER PUBLICATIONS

International Search Report and Written Opinion mailed Jun. 16, 2015, issued for PCT/JP2015/058995.

*Primary Examiner* — Thomas G Black
*Assistant Examiner* — Wae Louie
(74) *Attorney, Agent, or Firm* — Locke Lord LLP

(57) ABSTRACT

A construction machine control system for a construction machine that includes a work machine including a boom, an arm, and a bucket includes: an adjusting device having a movable spool and being capable of adjusting an amount of operating oil supplied to a hydraulic cylinder that drives the work machine with movement of the spool; an operation command unit adjusting the spool; a storage unit storing a plurality of pieces of correlation data indicating a relation between a cylinder speed of the hydraulic cylinder and an
(Continued)

operation command value of operating the hydraulic cylinder according to a type of the bucket; an acquiring unit acquiring type data indicating the type of the bucket; and a control unit selecting one piece of correlation data from the plurality of pieces of correlation data based on the type data and controlling the operation command value based on the selected correlation data.

8 Claims, 21 Drawing Sheets

(51) Int. Cl.

| | |
|---|---|
| ***E02F 9/20*** | (2006.01) |
| ***E02F 9/22*** | (2006.01) |
| ***E02F 9/26*** | (2006.01) |
| ***E02F 3/42*** | (2006.01) |
| *E02F 3/32* | (2006.01) |

(52) U.S. Cl.
CPC ..... *E02F 9/2029* (2013.01); *E02F 9/2228* (2013.01); *E02F 9/2271* (2013.01); *E02F 9/2285* (2013.01); *E02F 9/265* (2013.01); *E02F 3/32* (2013.01)

(58) Field of Classification Search
USPC ..... 701/50, 33.9, 34.4; 60/445; 172/3
See application file for complete search history.

(56) References Cited

U.S. PATENT DOCUMENTS

| | | | | |
|---|---|---|---|---|
| 2009/0090237 | A1* | 4/2009 | Nishikawa | E02F 9/2203 91/461 |
| 2015/0050110 | A1 | 2/2015 | Matsuyama et al. | |
| 2016/0138240 | A1* | 5/2016 | Ikegami | E02F 9/2285 701/50 |
| 2016/0265187 | A1* | 9/2016 | Baba | E02F 3/435 |
| 2016/0273194 | A1* | 9/2016 | Ikegami | E02F 3/435 |
| 2016/0281331 | A1* | 9/2016 | Ikegami | E02F 9/2228 |

FOREIGN PATENT DOCUMENTS

| | | | |
|---|---|---|---|
| JP | 2006-265954 | A | 10/2006 |
| JP | 2008-032174 | A | 2/2008 |
| JP | 2010-286074 | A | 12/2010 |
| JP | 2013-217138 | A | 10/2013 |

* cited by examiner

CONSTRUCTION MACHINE CONTROL SYSTEM, CONSTRUCTION MACHINE, AND CONSTRUCTION MACHINE CONTROL METHOD

FIELD

The present invention relates to a construction machine control system, a construction machine, and a construction machine control method.

BACKGROUND

A construction machine like an excavator includes a work machine including a boom, an arm, and a bucket. With respect to control of the construction machine, Patent Literature 1 and Patent Literature 2 disclose limited excavation control of moving a bucket based on a target excavation landform which is a target shape of an excavation object.

CITATION LIST

Patent Literature

Patent Literature 1: Japanese Laid-open Patent Publication No. 2013-217138

Patent Literature 2: Japanese Laid-open Patent Publication No. 2006-265954

SUMMARY

Technical Problem

In a case where a bucket is replaced with another bucket, if a bucket having a different weight is connected to an arm, a load acting on a hydraulic cylinder that drives a work machine may change. If the load acting on the hydraulic cylinder changes, the hydraulic cylinder may not execute an intended operation. As a result, for example, excavation accuracy may decrease.

An object of aspects of the present invention is to provide a construction machine control system, a construction machine, and a construction machine control method capable of suppressing a decrease in excavation accuracy.

Solution to Problem

A first aspect of the present invention provides a construction machine control system for a construction machine that includes a work machine including a boom, an arm, and a bucket and an operating device receiving an input of an operator's operation command for driving the work machine, the construction machine control system comprising: a hydraulic cylinder that drives the work machine; a direction control valve that has a movable spool and that supplies operating oil to the hydraulic cylinder with movement of the spool to operate the hydraulic cylinder; a control valve that allows the spool to be movable based on the operation command; a storage unit that stores a plurality of pieces of correlation data indicating a relation between a cylinder speed of the hydraulic cylinder and an operation command value indicating a value of an operation command signal for operating the hydraulic cylinder according to a type of the bucket; an acquiring unit that acquires type data indicating the type of the bucket; and a control unit that selects one piece of correlation data from the plurality of pieces of correlation data based on the type data and controls the operation command value based on the selected correlation data.

In the first aspect of the present invention, it is preferable that the hydraulic cylinder operates so that a lowering operation of the boom is executed, wherein the correlation data includes a relation between the cylinder speed of the hydraulic cylinder and the operation command value of operating the hydraulic cylinder in the lowering operation, and wherein the cylinder speed changes with respect to the operation command value based on the correlation data in the lowering operation.

In the first aspect of the present invention, it is preferable that the hydraulic cylinder operates so that a raising operation of the work machine is executed from an initial state where the cylinder speed is zero, and wherein an amount of change in the cylinder speed from the initial state in a slow-speed area where the cylinder speed is larger than zero and equal to or smaller than a predetermined speed is different between a first type bucket and a second type bucket.

In the first aspect of the present invention, it is preferable that the storage unit stores first correlation data indicating a relation between the cylinder speed and a movement amount of the spool, second correlation data indicating a relation between the movement amount of the spool and pressure of the pilot oil, and third correlation data indicating a relation between the pressure of the pilot oil and a control signal output from the control unit to the control valve, and wherein the control unit outputs the control signal to the control valve based on the first correlation data, the second correlation data, and the third correlation data so that the hydraulic cylinder moves at a target cylinder speed.

In the first aspect of the present invention, it is preferable that the construction machine control system further comprises a recycling circuit that returns a portion of the operating oil from a rod side of the hydraulic cylinder to a cap side of the boom cylinder by using load pressure according to weight of the work machine.

A second aspect of the present invention provides a construction machine comprising: a lower traveling structure; an upper swinging structure that is supported by the lower traveling structure; a work machine that includes a boom, an arm, and a bucket and is supported by the upper swinging structure; and the construction machine control system of the first aspect of the present invention.

A third aspect of the present invention provides a construction machine control method for a construction machine that includes a work machine including a boom, an arm, and a bucket and allows the work machine to be driven based on an operator's operation command, wherein the construction machine includes a hydraulic cylinder that drives the work machine, a direction control valve that has a movable spool and that supplies operating oil to the hydraulic cylinder with movement of the spool to operate the hydraulic cylinder, and a control valve that allows the spool to be movable based on the operation command, and the construction machine control method comprising: obtaining a plurality of pieces of first correlation data indicating a relation between a cylinder speed of the hydraulic cylinder and an operation command value indicating a value of an operation command signal for operating the hydraulic cylinder according to a type of the bucket; acquiring type data indicating the type of the bucket; selecting one piece of correlation data from the plurality of pieces of correlation data based on the type data; and controlling a movement amount of the spool based on the selected correlation data.

Advantageous Effects of Invention

According to the aspects of the present invention, a decrease in excavation accuracy is suppressed.

DESCRIPTION OF EMBODIMENTS

Hereinafter, an embodiment according to the present invention is described with reference to the drawings, and the present invention is not limited thereto. Requirements of the embodiment described hereinafter can be appropriately combined with each other. Moreover, some constituent components may not be used.

[Overall Configuration of Excavator]

Figure 1:
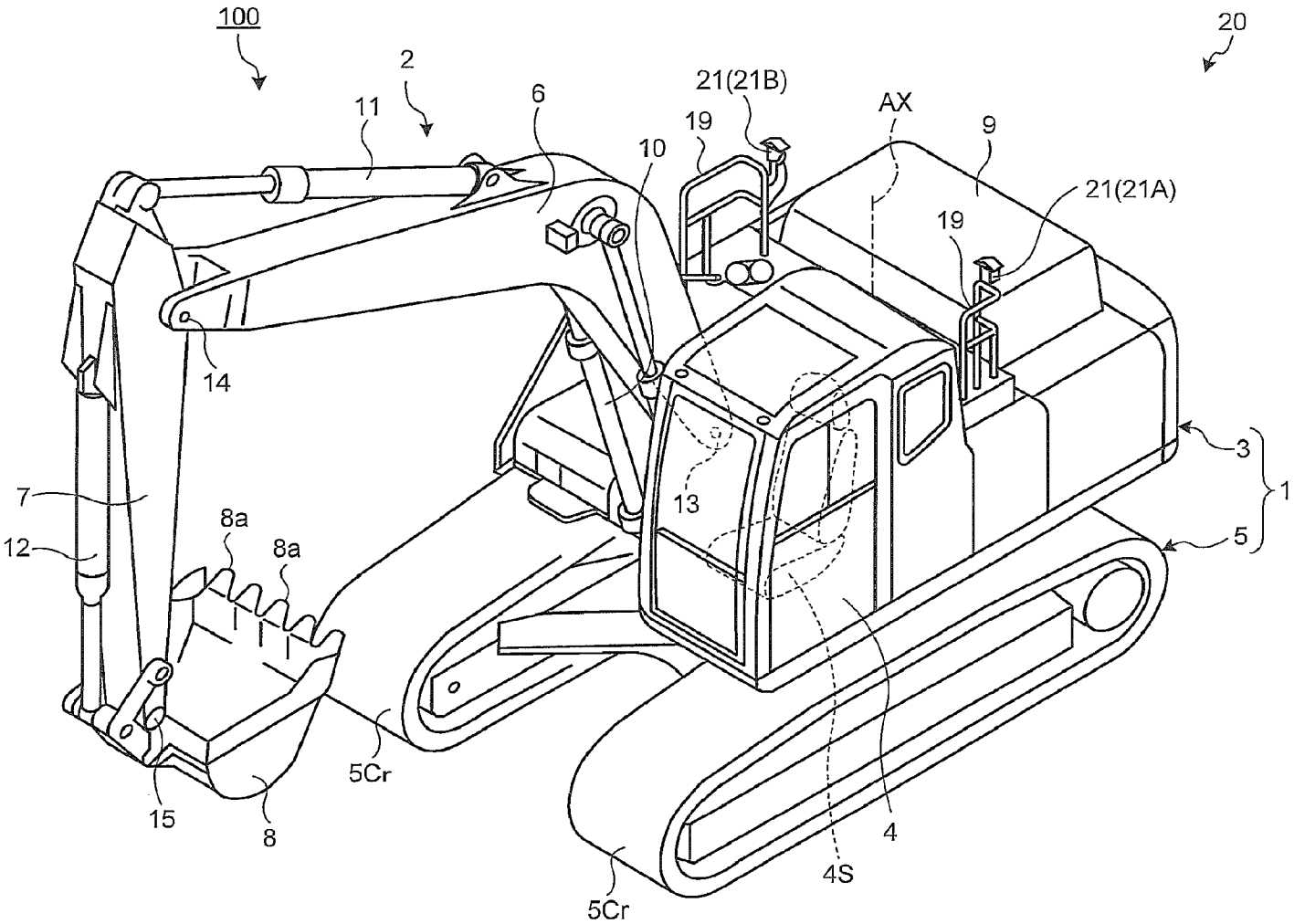
FIG. 1 is a perspective view illustrating an example of a construction machine.

FIG. 1 is a perspective view illustrating an example of a construction machine 100 according to the present embodiment. In the present embodiment, an example in which the construction machine 100 is an excavator 100 that includes a work machine 2 operating with hydraulic pressure.

As illustrated in FIG. 1, the excavator 100 includes a vehicle body 1 and the work machine 2. As will be described later, a control system 200 that executes excavation control is mounted on the excavator 100.

The vehicle body 1 includes a swinging structure 3, a cab 4, and a traveling device 5. The swinging structure 3 is disposed on the traveling device 5. The traveling device 5 supports the swinging structure 3. The swinging structure 3 may be referred to as an upper swinging structure 3. The traveling device 5 may be referred to as a lower traveling structure 5. The swinging structure 3 is capable of swinging about a swing axis AX. A driver's seat 4S on which an operator sits is provided in the cab 4. The operator operates the excavator 100 in the cab 4. The traveling device 5 includes a pair of crawler belts 5Cr. By rotation of the crawler belts 5Cr, the excavator 100 travels. Note that the traveling device 5 may include wheels (tires).

In the present embodiment, a positional relation of respective portions is described based on the driver's seat 4S. A front-rear direction refers to a front-rear direction based on the driver's seat 4S. A left-right direction refers to a left-right direction based on the driver's seat 4S. A direction in which the driver's seat 4S faces the front is defined as a front direction, and a direction opposite to the front direction is defined as a rear direction. The one direction (right side) and the other direction (left side) of lateral directions when the driver's seat 4S faces the front are defined as a right direction and a left direction.

The swinging structure 3 includes an engine room 9 that accommodates an engine, and a counterweight provided at a rear portion of the swinging structure 3. A handrail 19 is provided in the swinging structure 3 on the front side of the engine room 9. An engine, a hydraulic pump, and the like are disposed in the engine room 9.

The work machine 2 is supported by the swinging structure 3. The work machine 2 includes a boom 6 connected to the swinging structure 3, an arm 7 connected to the boom 6, a bucket 8 connected to the arm 7, a boom cylinder 10 driving the boom 6, an arm cylinder 11 driving the arm 7, and a bucket cylinder 12 driving the bucket 8. Each of the boom cylinder 10, the arm cylinder 11, and the bucket cylinder 12 is a hydraulic cylinder driven with operating oil.

A base end of the boom 6 is connected to the swinging structure 3 with a boom pin 13 interposed. A base end of the arm 7 is connected to a distal end of the boom 6 with an arm pin 14 interposed. The bucket 8 is connected to a distal end of the arm 7 with a bucket pin 15 interposed. The boom 6 is capable of rotating about the boom pin 13. The arm 7 is capable of rotating about the arm pin 14. The bucket 8 is capable of rotating about the bucket pin 15. Each of the arm 7 and the bucket 8 is a movable member capable of moving on the distal end side of the boom 6.

Figure 2:
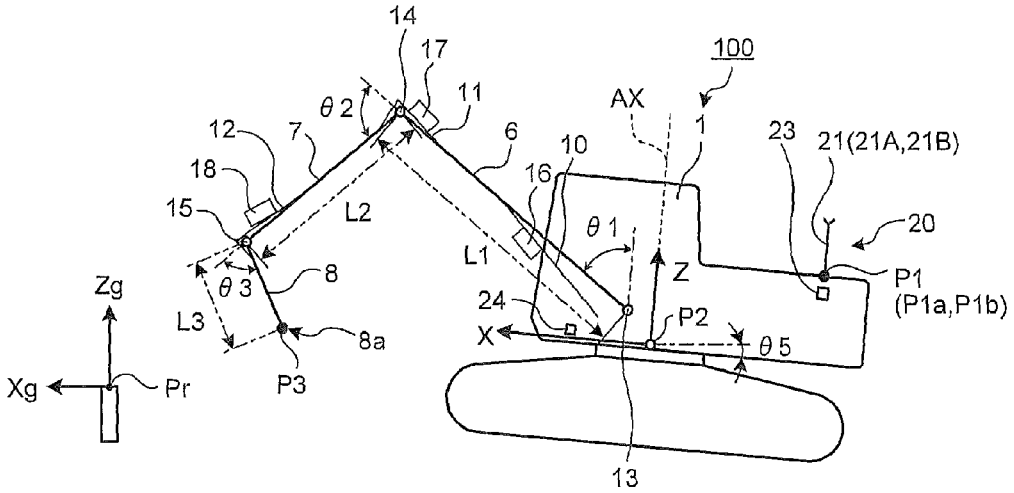
FIG. 2 is a side view schematically illustrating an example of the construction machine.
Figure 3:
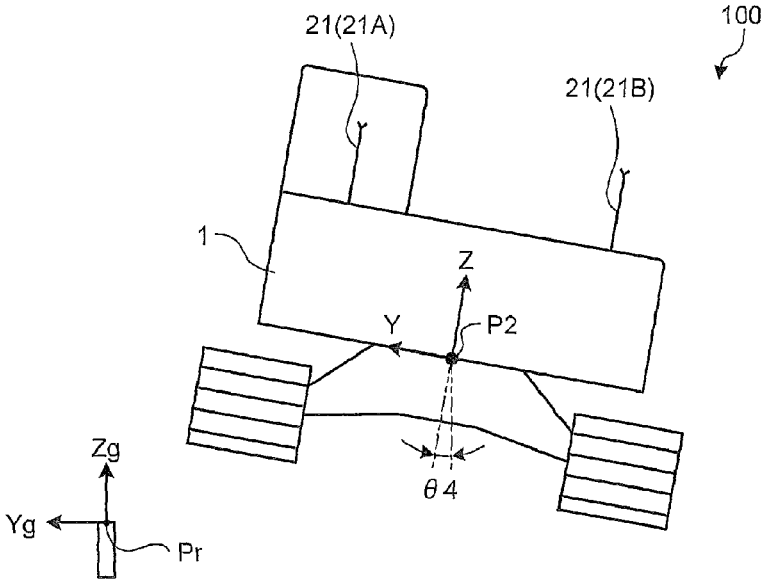
FIG. 3 is a rear view schematically illustrating an example of the construction machine.

FIG. 2 is a side view schematically illustrating the excavator 100 according to the present embodiment. FIG. 3 is a rear view schematically illustrating the excavator 100 according to the present embodiment. As illustrated in FIG. 2, the length L1 of the boom 6 is a distance between the boom pin 13 and the arm pin 14. The length L2 of the arm 7 is a distance between the arm pin 14 and the bucket pin 15. The length L3 of the bucket 8 is a distance between the bucket pin 15 and a distal end 8*a* of the bucket 8. In the present embodiment, the bucket 8 has a plurality of teeth. In the following description, the distal end 8*a* of the bucket 8 will be appropriately referred to as a cutting edge 8*a*.

Note that the bucket 8 may not have teeth. The distal end of the bucket 8 may be formed of a straight steel plate.

As illustrated in FIG. 2, the excavator 100 includes a boom cylinder stroke sensor 16 disposed in the boom cylinder 10, an arm cylinder stroke sensor 17 disposed in the arm cylinder 11, and a bucket cylinder stroke sensor 18 disposed in the bucket cylinder 12. A stroke length of the boom cylinder 10 is obtained based on a detection result of the boom cylinder stroke sensor 16. A stroke length of the arm cylinder 11 is obtained based on a detection result of the arm cylinder stroke sensor 17. A stroke length of the bucket cylinder 12 is obtained based on a detection result of the bucket cylinder stroke sensor 18.

In the following description, the stroke length of the boom cylinder 10 will be appropriately referred to as a boom cylinder length, the stroke length of the arm cylinder 11 will be appropriately referred to as an arm cylinder length, and the stroke length of the bucket cylinder 12 will be appropriately referred to as a bucket cylinder length. Moreover, in the following description, the boom cylinder length, the arm cylinder length, and the bucket cylinder length will be appropriately collectively referred to as cylinder length data L.

In addition, an angle sensor may be used for detecting the stroke lengths.

The excavator 100 includes a position detection device 20 capable of detecting a position of the excavator 100. The position detection device 20 includes an antenna 21, a global coordinate calculating unit 23, and an inertial measurement unit (IMU) 24.

The antenna 21 is a global navigation satellite systems (GNSS) antenna. The antenna 21 is a real time kinematic-global navigation satellite systems (RTK-GNSS) antenna. The antenna 21 is provided in the swinging structure 3. In the present embodiment, the antenna 21 is provided in the handrail 19 of the swinging structure 3. Note that the antenna 21 may be provided in the rear direction of the engine room 9. For example, the antenna 21 may be provided in the counterweight of the swinging structure 3. The antenna 21 outputs a signal corresponding to a received radio wave (GNSS radio wave) to the global coordinate calculating unit 23.

The global coordinate calculating unit 23 detects an installed position P1 of the antenna 21 in a global coordinate system. The global coordinate system is a three-dimensional coordinate system (Xg, Yg, Zg) based on a reference position Pr installed in a work area. As illustrated in FIGS. 2 and 3, in the present embodiment, the reference position Pr is a position of a distal end of a reference post set in the work area. Moreover, a local coordinate system refers to a three-dimensional coordinate system indicated by (X, Y, Z) based on the excavator 100. A reference position of the local coordinate system is data indicating a reference position P2 positioned at the swing axis (swing center) AX of the swinging structure 3.

In the present embodiment, the antenna 21 includes a first antenna 21A and a second antenna 21B provided in the swinging structure 3 so as to be separated in a vehicle width direction. The global coordinate calculating unit 23 detects an installed position Pla of the first antenna 21A and an installed position P1*b* of the second antenna 21B.

The global coordinate calculating unit 23 acquires reference position data P represented by a global coordinate. In the present embodiment, the reference position data P is data indicating the reference position P2 positioned at the swing axis (swing center) AX of the swinging structure 3. Note that the reference position data P may be data indicating the installed position P1. In the present embodiment, the global coordinate calculating unit 23 generates swinging structure direction data Q based on the two installed positions P1*a* and P1*b*. The swinging structure direction data Q is determined based on an angle between a line determined by the installed positions P1*a* and P1*b* and a reference direction (for example, the north) of the global coordinate. The swinging structure direction data Q indicates a direction in which the swinging structure 3 (the work machine 2) faces. The global coordinate calculating unit 23 outputs the reference position data P and the swinging structure direction data Q to a display controller 28 to be described later.

The IMU 24 is provided in the swinging structure 3. In the present embodiment, the IMU 24 is disposed under the cab 4. A high-rigidity frame is disposed in the swinging structure 3 under the cab 4. The IMU 24 is disposed on the frame. Note that the IMU 24 may be disposed on a lateral side (right side or left side) of the swing axis AX (the reference position P2) of the swinging structure 3. The IMU 24 detects a tilt angle θ4 with respect to the left-right direction of the vehicle body 1 and a tilt angle θ5 with respect to the front-rear direction of the vehicle body 1.

[Configuration of Control System]

Figure 4A:
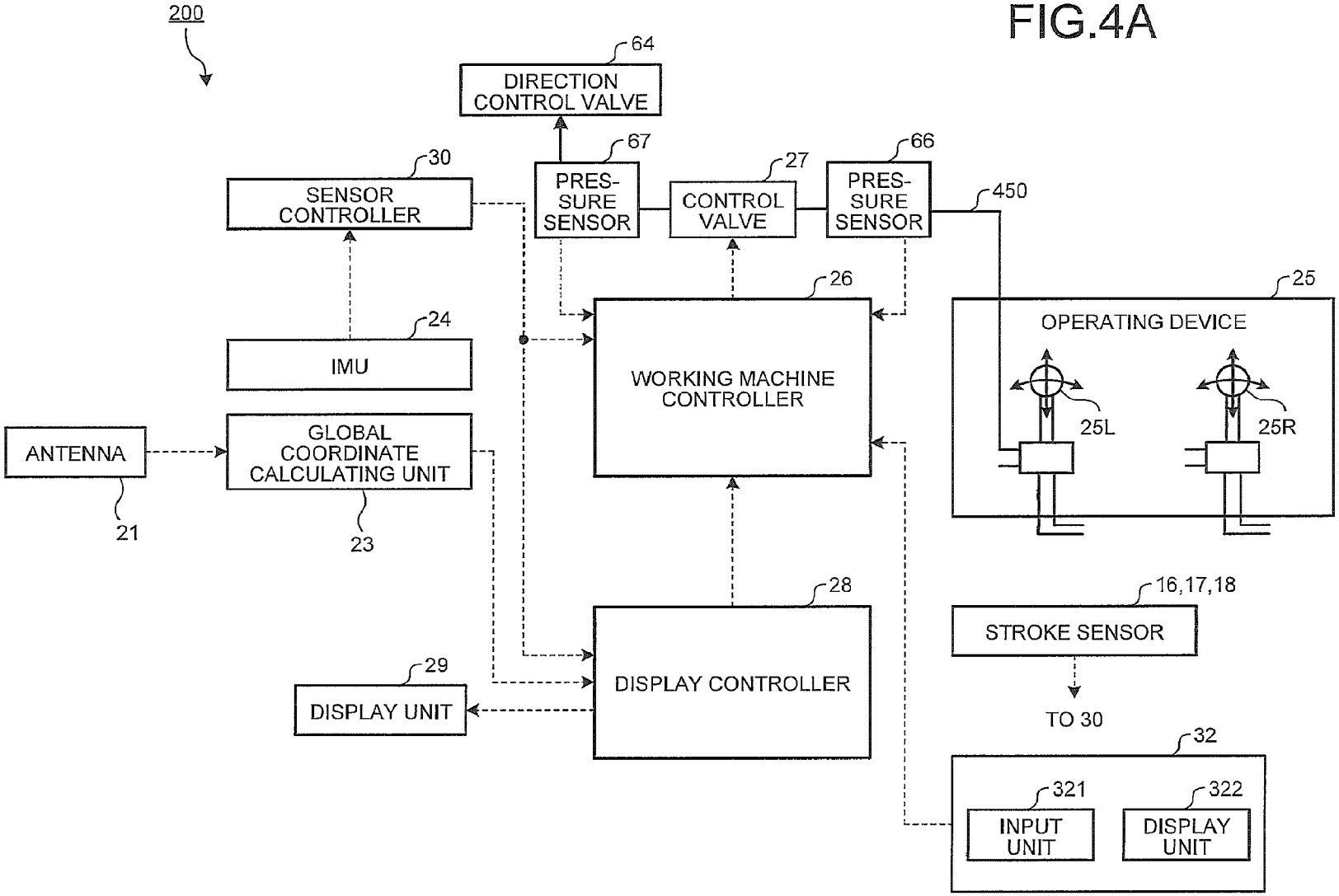
FIG. 4A is a block diagram illustrating an example of a control system.

Next, an overview of the control system 200 according to the present embodiment will be described. FIG. 4A is a block diagram illustrating a functional configuration of the control system 200 according to the present embodiment.

The control system 200 controls an excavation process using the work machine 2. The control of the excavation process includes limited excavation control. As illustrated in FIG. 4A, the control system 200 includes the boom cylinder stroke sensor 16, the arm cylinder stroke sensor 17, the bucket cylinder stroke sensor 18, the antenna 21, the global coordinate calculating unit 23, the IMU 24, an operating device 25, a work machine controller 26, a pressure sensor 66, a pressure sensor 67, a control valve 27, a direction control valve 64, a display controller 28, a display unit 29, a sensor controller 30, and a man machine interface 32.

The operating device 25 is disposed in the cab 4. The operating device 25 is operated by the operator. The operating device 25 receives an input of an operator's operation command for driving the work machine 2. In the present embodiment, the operating device 25 is a pilot hydraulic-type operating device.

In the following description, oil supplied to a hydraulic cylinder (the boom cylinder 10, the arm cylinder 11, and the bucket cylinder 12) in order to operate the hydraulic cylinder will be appropriately referred to as operating oil. In the present embodiment, the amount of operating oil supplied to the hydraulic cylinder is adjusted by the direction control valve 64. The direction control valve 64 operates with oil supplied. In the following description, oil supplied to the direction control valve 64 in order to operate the direction control valve 64 will be appropriately referred to as pilot oil. Moreover, the pressure of pilot oil will be appropriately referred to as pilot pressure.

The operating oil and the pilot oil may be delivered from the same hydraulic pump. For example, a portion of the operating oil delivered from a hydraulic pump is decompressed by a pressure-reducing valve and the decompressed operating oil may be used as the pilot oil. Moreover, a hydraulic pump (main hydraulic pump) that delivers operating oil and a hydraulic pump (pilot hydraulic pump) that delivers pilot oil may be different hydraulic pumps.

The operating device 25 includes a first operating lever 25R and a second operating lever 25L. The first operating lever 25R is disposed on the right side of the driver's seat 4S, for example. The second operating lever 25L is disposed on the left side of the driver's seat 4S, for example. In the first and second operating levers 25R and 25L, the front-rear and left-right operations correspond to two-axis operations.

The boom 6 and the bucket 8 are operated by the first operating lever 25R. The operation in the front-rear direction of the first operating lever 25R corresponds to an operation of the boom 6, and when the lever is operated in the front-rear direction, a lowering operation and a raising operation of the boom 6 are executed. The detection pressure generated in the pressure sensor 66 when the first operating lever 25R is operated in order to operate the boom 6 and the pilot oil is supplied to a pilot oil passage 450 will be referred to as detection pressure MB. The operation in the left-right direction of the first operating lever 25R corresponds to an operation of the bucket 8, and when the lever is operated in the left-right direction, an excavating operation and an opening operation of the bucket 8 are executed. The detection pressure generated in the pressure sensor 66 when the first operating lever 25R is operated in order to operate the bucket 8 and the pilot oil is supplied to the pilot oil passage 450 will be referred to as detection pressure MT.

The arm 7 and the swinging structure 3 are operated by the second operating lever 25L. The operation in the front-rear direction of the second operating lever 25L corresponds to an operation of the arm 7, and when the lever is operated in the front-rear direction, a raising operation and a lowering operation of the arm 7 are executed. The detection pressure generated in the pressure sensor 66 when the second operating lever 25L is operated in order to operate the arm 7 and the pilot oil is supplied to the pilot oil passage 450 will be referred to as detection pressure MA. The operation in the left-right direction of the second operating lever 25L corresponds to a swinging operation of the swinging structure 3, and when the lever is operated in the left-right direction, a right swinging operation and a left swinging operation of the swinging structure 3 are executed.

In the present embodiment, the raising operation of the boom 6 corresponds to a dumping operation. The lowering operation of the boom 6 corresponds to an excavating operation. The lowering operation of the arm 7 corresponds to the excavating operation. The raising operation of the arm 7 corresponds to the dumping operation. The lowering operation of the bucket 8 corresponds to the excavating operation. In addition, the lowering operation of the arm 7 may be referred to as a bending operation. The raising operation of the arm 7 may be referred to as an extending operation.

The pilot oil which has been delivered from the main hydraulic pump and decompressed to pilot pressure by the pressure-reducing valve is supplied to the operating device 25. The pilot pressure is adjusted based on the amount of operation of the operating device 25, and the direction control valve 64 via which operating oil supplied to the hydraulic cylinder (the boom cylinder 10, the arm cylinder 11, and the bucket cylinder 12) flows is driven according to the pilot pressure. The pressure sensor 66 and the pressure sensor 67 are disposed on a pilot hydraulic line 450. The pressure sensor 66 and the pressure sensor 67 detect pilot pressure. The detection results of the pressure sensor 66 and the pressure sensor 67 are output to the work machine controller 26.

The first operating lever 25R is operated in the front-rear direction in order to drive the boom 6. The direction control valve 64 via which the operating oil supplied to the boom cylinder 10 for driving the boom 6 flows is driven according to an amount of operation (amount of boom operation) of the first operating lever 25R in relation to the front-rear direction.

The first operating lever 25R is operated in the left-right direction in order to drive the bucket 8. The direction control valve 64 via which the operating oil supplied to the bucket cylinder 12 for driving the bucket 8 flows is driven according to an amount of operation (amount of bucket operation) of the first operating lever 25R in relation to the left-right direction.

The second operating lever 25L is operated in the front-rear direction in order to drive the arm 7. The direction control valve 64 via which the operating oil supplied to the arm cylinder 11 for driving the arm 7 flows is driven according to an amount of operation (amount of arm operation) of the second operating lever 25L in relation to the front-rear direction.

The second operating lever 25L is operated in the left-right direction in order to drive the swinging structure 3. The direction control valve 64 via which the operating oil supplied to a hydraulic actuator for driving the swinging structure 3 flows is driven according to an amount of operation of the second operating lever 25L in relation to the left-right direction.

Note that the operation in the left-right direction of the first operating lever 25R may correspond to the operation of the boom 6, and the operation in the front-rear direction may correspond to the operation of the bucket 8. Note that the operation in the left-right direction of the second operating lever 25L may correspond to the operation of the arm 7, and the operation in the front-rear direction may correspond to the operation of the swinging structure 3.

The control valve 27 operates to adjust the amount of operating oil supplied to the hydraulic cylinder (boom cylinder 10, arm cylinder 11, and bucket cylinder 12). The control valve 27 operates based on a control signal from the work machine controller 26.

The man machine interface 32 includes an input unit 321 and a display unit (monitor) 322. In the present embodiment, the input unit 321 includes operation buttons arranged around the display unit 322. In addition, the input unit 321 may include a touch panel. The man machine interface 32 may be referred to as a multi-monitor 32. The display unit 322 displays an amount of remaining fuel, a temperature of cooling water, and the like as basic information. The input unit 321 is operated by an operator. A command signal generated according to an operation of the input unit 321 is output to the work machine controller 26.

The sensor controller 30 calculates a boom cylinder length based on a detection result of the boom cylinder stroke sensor 16. The boom cylinder stroke sensor 16 outputs a phase shift pulse associated with a swinging operation to the sensor controller 30. The sensor controller 30 calculates the boom cylinder length based on the phase shift pulse output from the boom cylinder stroke sensor 16. Similarly, the sensor controller 30 calculates the arm cylinder length based on a detection result of the arm cylinder stroke sensor 17. The sensor controller 30 calculates the bucket cylinder length based on a detection result of the bucket cylinder stroke sensor 18.

The sensor controller 30 calculates a tilt angle θ1 of the boom 6 with respect to the vertical direction of the swinging structure 3 from the boom cylinder length acquired based on the detection result of the boom cylinder stroke sensor 16. The sensor controller 30 calculates a tilt angle θ2 of the arm 7 with respect to the boom 6 from the arm cylinder length acquired based on the detection result of the arm cylinder stroke sensor 17. The sensor controller 30 calculates a tilt angle θ3 of the cutting edge 8*a* of the bucket 8 with respect to the arm 7 from the bucket cylinder length acquired based on the detection result of the bucket cylinder stroke sensor 18.

Note that the tilt angle θ1 of the boom 6, the tilt angle θ2 of the arm 7, and the tilt angle θ3 of the bucket 8 may not be detected by the cylinder stroke sensors. The tilt angle θ1 of the boom 6 may be detected by an angle detector such as a rotary encoder. The angle detector detects a bending angle of the boom 6 with respect to the swinging structure 3 to detect the tilt angle θ1. Similarly, the tilt angle θ2 of the arm 7 may be detected by an angle detector attached to the arm 7. The tilt angle θ3 of the bucket 8 may be detected by an angle detector attached to the bucket 8.

Figure 4B:
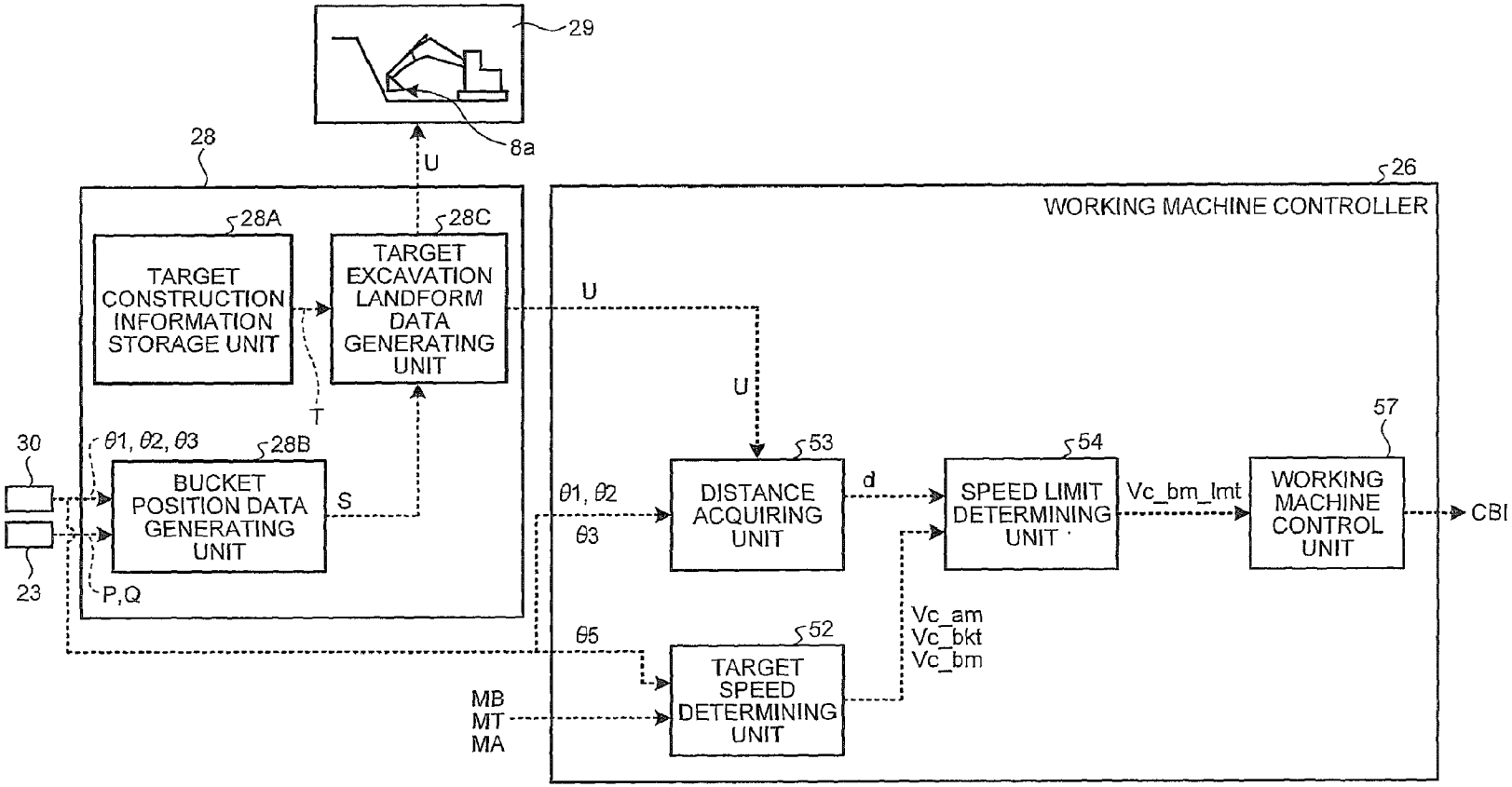
FIG. 4B is a block diagram illustrating an example of the control system.

FIG. 4B is a block diagram illustrating a work machine controller 26, a display controller 28, and a sensor controller 30. The sensor controller 30 acquires cylinder length data L from the detection result of each of the cylinder stroke sensors 16, 17, and 18. The sensor controller 30 inputs data of the tilt angle θ4 and data of the tilt angle θ5 output from the IMU 24. The sensor controller 30 outputs the cylinder length data L, the data of the tilt angle θ4, and the data of the tilt angle θ5 to the display controller 28 and the work machine controller 26, respectively.

As described above, in the present embodiment, the detection results of the cylinder stroke sensors (16, 17, and 18) and the detection result of the IMU 24 are output to the sensor controller 30, and the sensor controller 30 performs a predetermined calculating process. In the present embodiment, the functions of the sensor controller 30 may be performed by the work machine controller 26. For example, the detection results of the cylinder stroke sensors (16, 17, and 18) may be output to the work machine controller 26, and the work machine controller 26 may calculate the cylinder lengths (the boom cylinder length, the arm cylinder length, and the bucket cylinder length) based on the detection results of the cylinder stroke sensors (16, 17, and 18). The detection result of the IMU 24 may be output to the work machine controller 26.

The display controller 28 includes a target construction information storage unit 28A, a bucket position data generating unit 28B, and a target excavation landform data generating unit 28C. The display controller 28 acquires the reference position data P and the swinging structure direction data Q from the global coordinate calculating unit 23. The display controller 28 acquires the tilt angles θ1, θ2, and θ3 of the cylinder from the sensor controller 30.

The bucket position data generating unit 28B generates the bucket position data indicating a three-dimensional position of the bucket 8 based on the reference position data P, the swinging structure direction data Q, and the cylinder length data L. In the present embodiment, the bucket position data is a cutting edge position data S indicating a three-dimensional position P3 of the cutting edge 8*a*.

The target excavation landform data generating unit 28C generates a target excavation landform U indicating a target shape of an excavation object using the cutting edge position data S acquired from the bucket position data generating unit 28B and target construction information T to be described later stored in the target construction information storage unit 28A. Moreover, the display controller 28 displays the target excavation landform on the display unit 29 based on the target excavation landform U. The display unit 29 is a monitor, for example, and displays various types of information of the excavator 100. In the present embodiment, the display unit 29 includes a human machine interface (HMI) monitor as an information-oriented construction guidance monitor.

The target construction information storage unit 28A stores the target construction information (three-dimensional designed landform data) T indicating a three-dimensional designed landform which is a target shape of a work area. The target construction information T includes coordinate data and angle data necessary for generating the target excavation landform (designed landform data) U indicating a designed landform which is a target shape of an excavation object. The target construction information T may be supplied to the display controller 28 via a radio communication device, for example. Note that the position information of the cutting edge 8*a* may be transferred from a connection-type recording device such as a memory.

Figure 5:
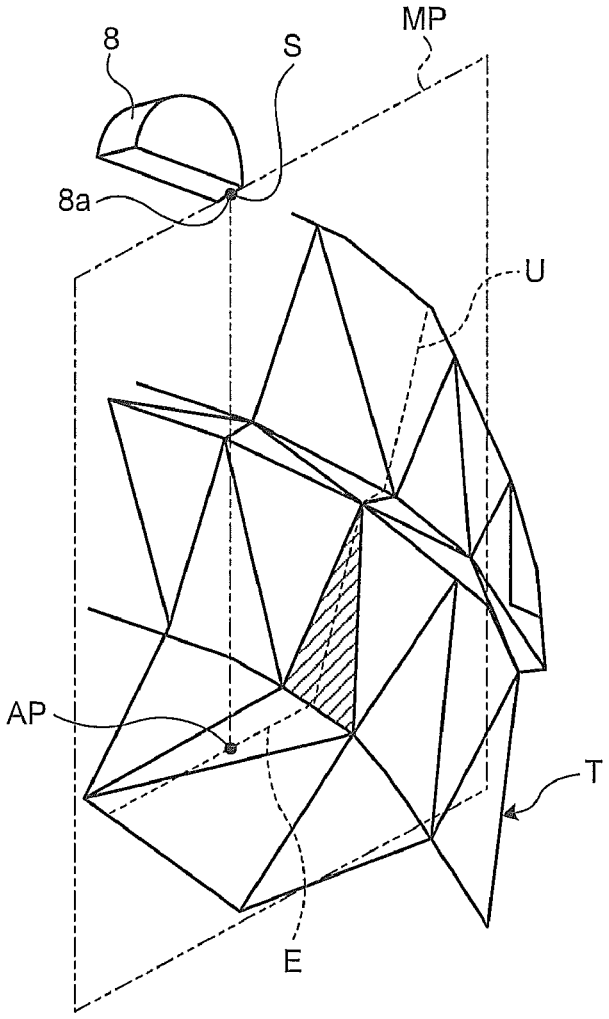
FIG. 5 is a schematic view illustrating an example of target construction information.

The target excavation landform data generating unit 28C acquires a nodal line E between a working plane MP of the work machine 2 defined in the front-rear direction of the swinging structure 3 and the three-dimensional designed landform as illustrated in FIG. 5 as a candidate line of the target excavation landform U based on the target construction information T and the cutting edge position data S. The target excavation landform data generating unit 28C sets a point located immediately below the bucket cutting edge 8*a* in the candidate line of the target excavation landform U as a reference point AP of the target excavation landform U. The display controller 28 determines one or more inflection points appearing before and after the reference point AP of the target excavation landform U and lines appearing before and after the inflection points as the target excavation landform U which serves as an excavation object. The target excavation landform data generating unit 28C generates the target excavation landform U indicating a designed landform which is a target shape of the excavation object. The target excavation landform data generating unit 28C displays the target excavation landform U on the display unit 29 based on the target excavation landform U. The target excavation landform U is work data used for excavation work. The target excavation landform U is displayed on the display unit 29 based on display designed landform data used for displaying on the display unit 29.

The display controller 28 is capable of calculating the local coordinate position when seen in the global coordinate system based on the detection result of the position detection device 20. The local coordinate system is a three-dimensional coordinate system based on the excavator 100. The reference position of the local coordinate system is the reference position P2 positioned at the swing center AX of the swinging structure 3, for example.

The work machine controller 26 includes a target speed determining unit 52, a distance acquiring unit 53, a speed limit determining unit 54, and a work machine control unit 57. The work machine controller 26 acquires the detection pressure MB, MA, and MT, acquires the tilt angles θ1, θ2, θ3, and θ5 from the sensor controller 30, acquires the target excavation landform U from the display controller 28, and output a command CBI to the control valve 27.

The target speed determining unit 52 calculates the tilt angle θ5 with respect to the front-rear direction of the vehicle body 1 and the pressure MB, MA, and MT acquired from the pressure sensor 66 as Vc_bm, Vc_am, and Vc_bk corresponding to the lever operations for driving the respective work machines of the boom 6, the arm 7, and the bucket 8.

When the distance acquiring unit 53 corrects the pitch of the distance of the cutting edge 8*a* of the bucket 8 in a cycle (for example, every 10 msec) shorter than that used in the display controller 28, the distance acquiring uses the angle θ5 output from the IMU 24 in addition to the tilt angles θ1, θ2, and θ3, the lengths L1, L2, and L3, and the position information of the boom pin 13. The position relation between the reference position P2 of the local coordinate system and the installed position P1 of the antenna 21 is known. The work machine controller 26 calculates the cutting edge position data of a position P3 of the cutting edge 8*a* in the local system from the detection result of the position detection device 20 and the position information of the antenna 21.

The distance acquiring unit 53 acquires the target excavation landform U. The distance acquiring unit 53 calculates a distance d between the cutting edge 8*a* of the bucket 8 in the direction vertical to the target excavation landform U and the target excavation landform U based on the cutting edge position data of the cutting edge 8*a* in the local coordinate system and the target excavation landform U.

The speed limit determining unit 54 acquires a speed limit in the vertical direction with respect to the target excavation landform U corresponding to the distance d. The speed limit includes table information or graph information stored in advance in a storage unit 261 (see FIG. 24) of the work machine controller 26. The speed limit determining unit 54 calculates a relative speed of the cutting edge 8*a* in the vertical direction with respect to the target excavation landform U based on the target speeds Vc_bm, Vc_am, and Vc_bk of the cutting edge 8*a* acquired from the target speed determining unit 52. The work machine controller 26 calculates a speed limit Vc_lmt of the cutting edge 8*a* based on the distance d. The speed limit determining unit 54 calculates a boom speed limit Vc_bm_lmt for limiting the movement of the boom 6 based on the distance d, the target speeds Vc_bm, Vc_am, and Vc_bk, and the speed limit Vc_lmt.

The work machine control unit 57 acquires the boom speed limit Vc_bm_lmt and generates a control signal CBI to a control valve 27C for outputting a raising command to the boom cylinder 10 based on the boom speed limit Vc_bm_lmt so that the relative speed of the cutting edge 8*a* becomes equal to or less than the speed limit. The work machine controller 26 outputs a control signal for limiting the speed of the boom 6 to the control valve 27C connected to the boom cylinder 10.

Figure 6:
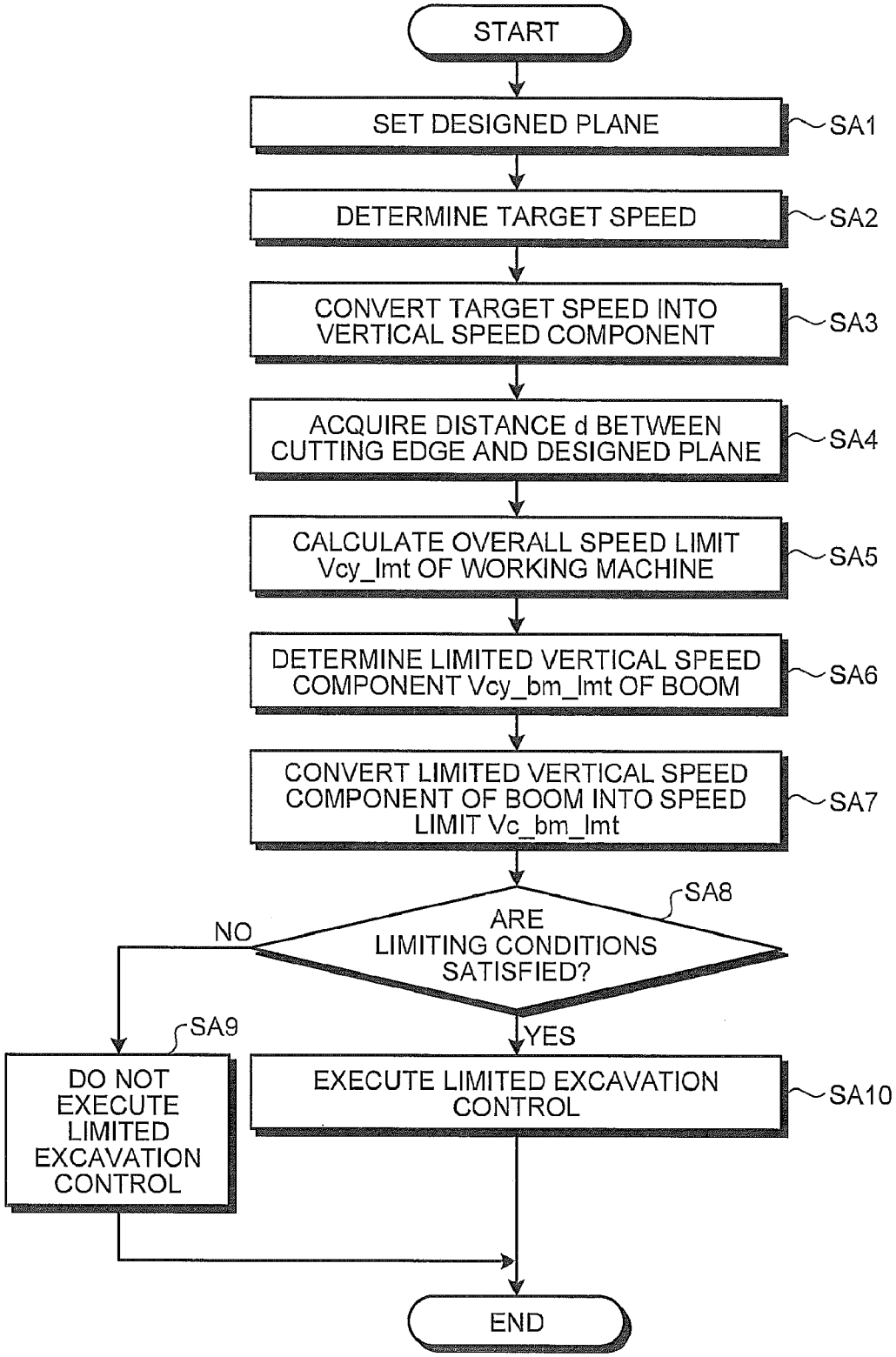
FIG. 6 is a flowchart illustrating an example of limited excavation control.

Hereinafter, an example of limited excavation control according to the present embodiment will be described with reference to the flowchart of FIG. 6 and the schematic diagrams of FIGS. 7 to 14. FIG. 6 is a flowchart illustrating an example of the limited excavation control according to the present embodiment.

As described above, the target excavation landform U is set (step SA1). After the target excavation landform U is set, the work machine controller 26 determines a target speed Vc of the work machine 2 (step SA2). The target speed Vc of the work machine 2 includes the boom target speed Vc_bm, the arm target speed Vc_am, and a bucket target speed Vc_bkt. The boom target speed Vc_bm is a speed of the cutting edge 8*a* when the boom cylinder 10 only is driven. The arm target speed Vc_am is a speed of the cutting edge 8*a* when the arm cylinder 11 only is driven. The bucket target speed Vc_bkt is a speed of the cutting edge 8*a* when the bucket cylinder 12 only is driven. The boom target speed Vc_bm is calculated based on an amount of boom operation. The arm target speed Vc_am is calculated based on an amount of arm operation. The bucket target speed Vc_bkt is calculated based on an amount of bucket operation.

Target speed information that defines the relation between the amount of boom operation and the boom target speed Vc_bm is stored in the storage unit 261 of the work machine controller 26. The work machine controller 26 determines the boom target speed Vc_bm corresponding to the amount of boom operation based on the target speed information. The target speed information is, for example, a map in which the magnitude of the boom target speed Vc_bm with respect to the amount of boom operation is described. The target speed information may be in a form of a table, a numerical expression, or the like. The target speed information includes information that defines the relation between the amount of arm operation and the arm target speed Vc_am. The target speed information includes information that defines the relation between the amount of bucket operation and the bucket target speed Vc_bkt. The work machine controller 26 determines the arm target speed Vc_am corresponding to the amount of arm operation based on the target speed information. The work machine controller 26 determines the bucket target speed Vc_bkt corresponding to the amount of bucket operation based on the target speed information.

Figure 7:
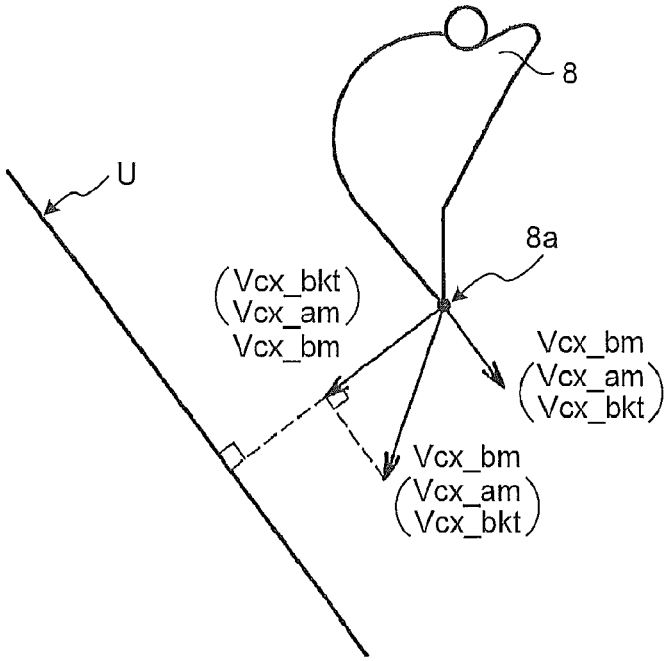
FIG. 7 is a diagram for describing an example of the limited excavation control.

As illustrated in FIG. 7, the work machine controller 26 converts the boom target speed Vc_bm into a speed component (vertical speed component) Vcy_bm in the direction vertical to a surface of the target excavation landform U and a speed component (horizontal speed component) Vcx_bm in the direction parallel to the surface of the target excavation landform U (step SA3).

The work machine controller 26 obtains an inclination of the vertical axis (the swing axis AX of the swinging structure 3) of the local coordinate system with respect to the vertical axis of the global coordinate system and an inclination in the vertical direction of the surface of the target excavation landform U with respect to the vertical axis of the global coordinate system from the reference position data P, the target excavation landform U, and the like. The work machine controller 26 obtains an angle β1 representing the inclination between the vertical axis of the local coordinate system and the vertical direction of the surface of the target excavation landform U from these inclinations.

Figure 8:
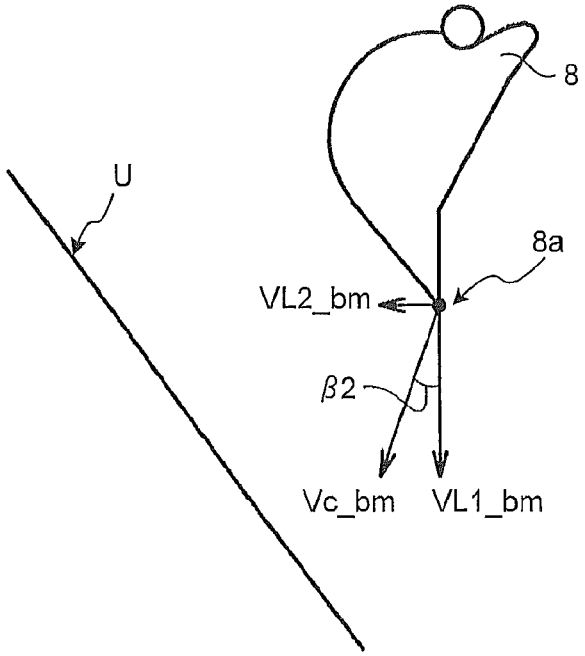
FIG. 8 is a diagram for describing an example of the limited excavation control.

As illustrated in FIG. 8, the work machine controller 26 converts the boom target speed Vc_bm into a speed component VL1_bm in the vertical axis direction of the local coordinate system and a speed component VL2_bm in the horizontal axis direction by a trigonometric function from an angle β2 between the vertical axis of the local coordinate system and the direction of the boom target speed Vc_bm.

Figure 9:
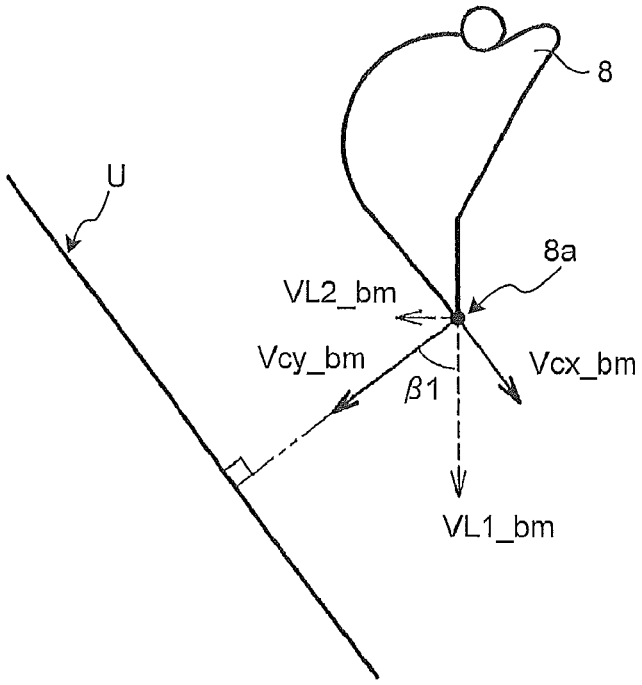
FIG. 9 is a diagram for describing an example of the limited excavation control.

As illustrated in FIG. 9, the work machine controller 26 converts the speed component VL1_bm in the vertical axis direction of the local coordinate system and the speed component VL2_bm in the horizontal axis direction into a vertical speed component Vcy_bm and a horizontal speed component Vcx_bm with respect to the target excavation landform U by a trigonometric function from the inclination β1 between the vertical axis of the local coordinate system and the vertical direction of the surface of the target excavation landform U. Similarly, the work machine controller 26 converts the arm target speed Vc_am into a vertical speed component Vcy_am and a horizontal speed component Vcx_am in the vertical axis direction of the local coordinate system. The work machine controller 26 converts the bucket target speed Vc_bkt into a vertical speed component Vcy_bkt and a horizontal speed component Vcx_bkt in the vertical axis direction of the local coordinate system.

Figure 10:
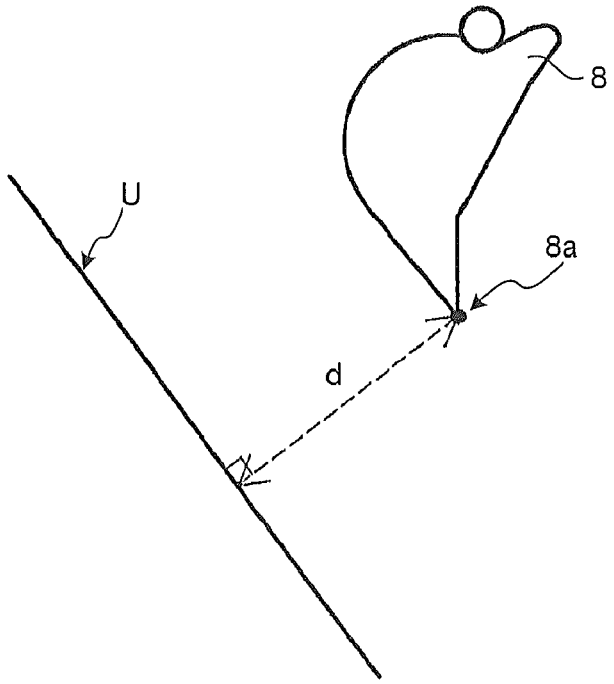
FIG. 10 is a diagram for describing an example of the limited excavation control.

As illustrated in FIG. 10, the work machine controller 26 acquires the distance d between the cutting edge 8*a* of the bucket 8 and the target excavation landform U (step SA4). The work machine controller 26 calculates the shortest distance d between the cutting edge 8*a* of the bucket 8 and the surface of the target excavation landform U from the position information of the cutting edge 8*a*, the target excavation landform U, and the like. In the present embodiment, the limited excavation control is executed based on the shortest distance d between the cutting edge 8*a* of the bucket 8 and the surface of the target excavation landform U.

The work machine controller 26 calculates an overall speed limit Vcy_lmt of the work machine 2 based on the distance d between the cutting edge 8*a* of the bucket 8 and the surface of the target excavation landform U (step SA5). The overall speed limit Vcy_lmt of the work machine 2 is an allowable moving speed of the cutting edge 8*a* in the direction in which the cutting edge 8*a* of the bucket 8 approaches the target excavation landform U. Speed limit information that defines the relation between the distance d and the speed limit Vcy_lmt is stored in a storage unit 261 of the work machine controller 26.

Figure 11:
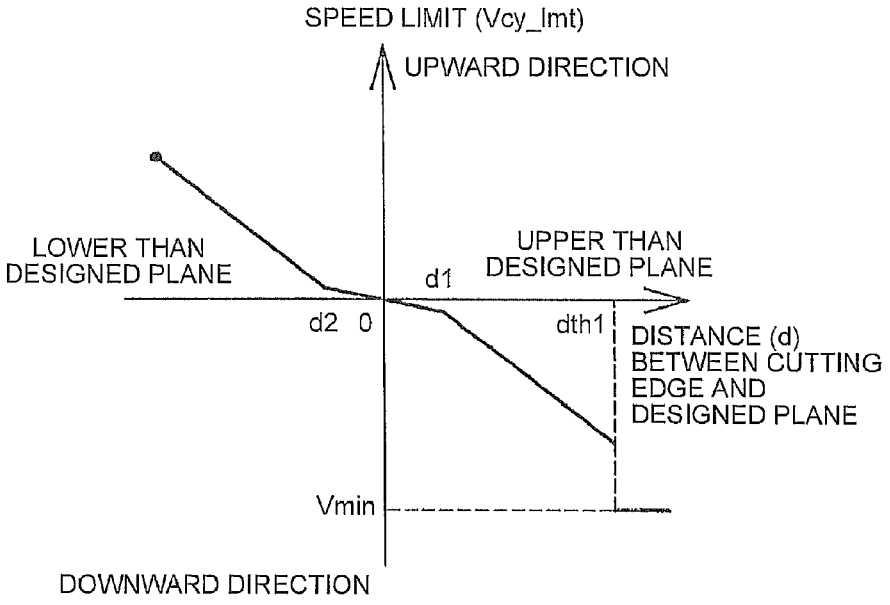
FIG. 11 is a diagram for describing an example of the limited excavation control.

FIG. 11 illustrates an example of the speed limit information according to the present embodiment. In the present embodiment, the distance d has a positive value when the cutting edge 8*a* is positioned on the outer side of the surface of the target excavation landform U, that is, on the side close to the work machine 2 of the excavator 100, and the distance d has a negative value when the cutting edge 8*a* is positioned on the inner side of the surface of the target excavation landform U, that is, on the inner side of the excavation object than the target excavation landform U. As illustrated in FIG. 10, the distance d has a positive value when the cutting edge 8*a* is positioned above the surface of the target excavation landform U. The distance d has a negative value when the cutting edge 8*a* is positioned under the surface of the target excavation landform U. Moreover, the distance d has a positive value when the cutting edge 8*a* is positioned at such a position that the cutting edge 8*a* does not dig into the target excavation landform U. The distance d has a negative value when the cutting edge 8*a* is positioned at such a position that the cutting edge 8*a* digs into the target excavation landform U. The distance d is zero when the cutting edge 8*a* is positioned on the target excavation landform U, that is, when the cutting edge 8*a* is in contact with the target excavation landform U.

In the present embodiment, the speed has a positive value when the cutting edge 8*a* moves from the inner side of the target excavation landform U toward the outer side, and the speed has a negative value when the cutting edge 8*a* moves from the outer side of the target excavation landform U toward the inner side. That is, the speed has a positive value when the cutting edge 8*a* moves toward the upper side of the target excavation landform U, and the speed has a negative value when the cutting edge 8*a* moves toward the lower side of the target excavation landform U.

In the speed limit information, an inclination of the speed limit Vcy_lmt when the distance d is between d1 and d2 is smaller than an inclination when the distance d is equal to or more than d1 or equal to or less than d2. d1 is larger than zero. d2 is smaller than zero. In operations near the surface of the target excavation landform U, in order to set the speed limit more accurately, the inclination when the distance d is between d1 and d2 is made smaller than the inclination when the distance d is equal to or more than d1 or equal to or less than d2. The speed limit Vcy_lmt has a negative value when the distance d is equal to or more than d1, and the larger the distance d, the smaller the speed limit Vcy_lmt. That is, when the distance d is equal to or more than d1, the farther the cutting edge 8*a* above the target excavation landform U from the surface of the target excavation landform U, the larger the speed of moving toward the lower side of the target excavation landform U and the larger the absolute value of the speed limit Vcy_lmt. When the distance d is equal to or less than zero, the speed limit Vcy_lmt has a positive value, and the smaller the distance d, the larger the speed limit Vcy_lmt. That is, when the distance d of the cutting edge 8*a* of the bucket 8 from the target excavation landform U is equal to or less than zero, the farther the cutting edge 8*a* on the lower side of the target excavation landform U from the target excavation landform U, the larger the speed of moving toward the upper side of the target excavation landform U, and the larger the absolute value of the speed limit Vcy_lmt.

When the distance d is equal to or more than a predetermined value dth1, the speed limit Vcy_lmt becomes Vmin. The predetermined value dth1 is a positive value and is larger than d1. Vmin is smaller than the smallest value of the target speed. That is, when the distance d is equal to or more than the predetermined value dth1, the operation of the work machine 2 is not limited. Thus, when the cutting edge 8*a* is separated greatly from the target excavation landform U on the upper side of the target excavation landform U, the operation of the work machine 2 is not limited, that is, the limited excavation control is not performed. When the distance d is smaller than the predetermined value dth1, the operation of the work machine 2 is limited. When the distance d is smaller than the predetermined value dth1, the operation of the boom 6 is limited.

The work machine controller 26 calculates a vertical speed component (limited vertical speed component) Vcy_bm_lmt of the speed limit of the boom 6 from the overall speed limit Vcy_lmt of the work machine 2, the arm target speed Vc_am, and the bucket target speed Vc_bkt (step SA6).

Figure 12:
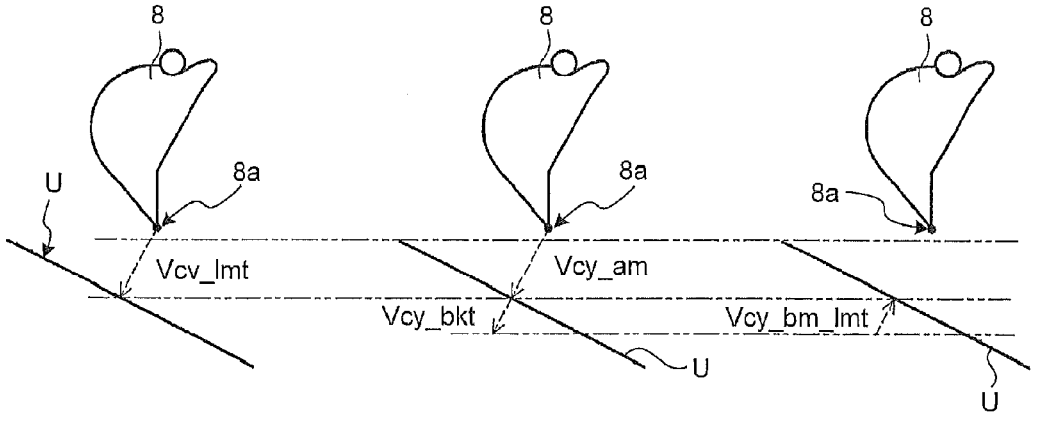
FIG. 12 is a diagram for describing an example of limited excavation control.

As illustrated in FIG. 12, the work machine controller 26 calculates the limited vertical speed component Vcy_bm_lmt of the boom 6 by subtracting the vertical speed component Vcy_am of the arm target speed and the vertical speed component Vcy_bkt of the bucket target speed from the overall speed limit Vcy_lmt of the work machine 2.

Figure 13:
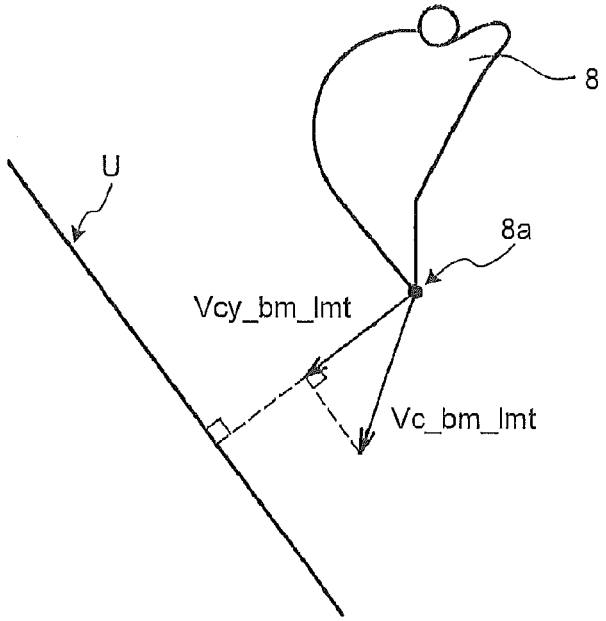
FIG. 13 is a diagram for describing an example of the limited excavation control.

As illustrated in FIG. 13, the work machine controller 26 converts the limited vertical speed component Vcy_bm_lmt of the boom 6 into a speed limit (boom speed limit) Vc_bm_lmt of the boom 6 (step SA7). The work machine controller 26 obtains the relation between a direction vertical to the surface of the target excavation landform U and the direction of the boom speed limit Vc_bm_lmt from a rotation angle α of the boom 6, a rotation angle β of the arm 7, a rotation angle of the bucket 8, vehicle body position data P, the target excavation landform U, and the like and converts the limited vertical speed component Vcy_bm_lmt of the boom 6 into the boom speed limit Vc_bm_lmt. The calculation in this case is performed in a reverse order to that of the above-described calculation of obtaining the vertical speed component Vcy_bm in the direction vertical to the surface of the target excavation landform U from the boom target speed Vc_bm. After that, a cylinder speed corresponding to a boom intervention amount is determined, and an opening command corresponding to the cylinder speed is output to the control valve 27C.

The pilot pressure based on the lever operation is filled in an oil passage 451B and the pilot pressure based on boom intervention is filled in an oil passage 502. A shuttle valve 51 selects the oil passage having the larger pressure (step SA8).

For example, in a case of lowering the boom 6, when the magnitude of the boom speed limit Vc_bm_lmt in the downward direction of the boom 6 is smaller than the magnitude of the boom target speed Vc_bm in the downward direction, limiting conditions are satisfied. Moreover, in a case of raising the boom 6, when the magnitude of the boom speed limit Vc_bm_lmt in the upward direction of the boom 6 is larger than the magnitude of the boom target speed Vc_bm in the upward direction, the limiting conditions are satisfied.

The work machine controller 26 controls the work machine 2. When controlling the boom 6, the work machine controller 26 controls the boom cylinder 10 by transmitting a boom command signal to the control valve 27C. The boom command signal has a current value corresponding to a boom command speed. If necessary, the work machine controller 26 controls the arm 7 and the bucket 8. The work machine controller 26 controls the arm cylinder 11 by transmitting an arm command signal to the control valve 27. The arm command signal has a current value corresponding to an arm command speed. The work machine controller 26 controls the bucket cylinder 12 by transmitting a bucket command signal to the control valve 27. The bucket command signal has a current value corresponding to a bucket command speed.

When the limiting conditions are not satisfied, the shuttle valve 51 selects the supply of operating oil from the oil passage 451B, and a normal operation is performed (step SA9). The work machine controller 26 operates the boom cylinder 10, the arm cylinder 11, and the bucket cylinder 12 according to the amount of boom operation, the amount of arm operation, and the amount of bucket operation. The boom cylinder 10 operates at the boom target speed Vc_bm. The arm cylinder 11 operates at the arm target speed Vc_am. The bucket cylinder 12 operates at the bucket target speed Vc_bkt.

When the limiting conditions are satisfied, the shuttle valve 51 selects the supply of operating oil from the oil passage 502, and the limited excavation control is executed (step SA10).

The limited vertical speed component Vcy_bm_lmt of the boom 6 is calculated by subtracting the vertical speed component Vcy_am of the arm target speed and the vertical speed component Vcy_bkt of the bucket target speed from the overall speed limit Vcy_lmt of the work machine 2. Thus, when the overall speed limit Vcy_lmt of the work machine 2 is smaller than the sum of the vertical speed component Vcy_am of the arm target speed and the vertical speed component Vcy_bkt of the bucket target speed, the limited vertical speed component Vcy_bm_lmt of the boom 6 becomes such a negative value that the boom is raised.

Thus, the boom speed limit Vc_bm_lmt becomes a negative value. In this case, the work machine controller 27 lowers the boom 6 at a speed lower than the boom target speed Vc_bm. For this reason, it is possible to prevent the bucket 8 from digging into the target excavation landform U while suppressing the sense of incongruity the operator might feel.

When the overall speed limit Vcy_lmt of the work machine 2 is larger than the sum of the vertical speed component Vcy_am of the arm target speed and the vertical speed component Vcy_bkt of the bucket target speed, the limited vertical speed component Vcy_bm_lmt of the boom 6 becomes a positive value. Thus, the boom speed limit Vc_bm_lmt becomes a positive value. In this case, even when the operating device 25 is operated in a direction in which the boom 6 is lowered, the work machine controller 26 raises the boom 6. For this reason, it is possible to quickly suppress expansion of a dug area of the target excavation landform U.

When the cutting edge 8*a* is positioned above the target excavation landform U, the closer the cutting edge 8*a* to the target excavation landform U, the smaller the absolute value of the limited vertical speed component Vcy_bm_lmt of the boom 6, and also the smaller the absolute value of a speed component (limited horizontal speed component) Vcx_bm_lmt of the speed limit of the boom 6 in the direction parallel to the surface of the target excavation landform U. Thus, when the cutting edge 8*a* is positioned above the target excavation landform U, the closer the cutting edge 8*a* to the target excavation landform U, the more both the speed of the boom 6 in the direction vertical to the surface of the target excavation landform U and the speed of the boom 6 in the direction parallel to the surface of the target excavation landform U are reduced. When the left operating lever 25L and the right operating lever 25R are operated simultaneously by the operator of the excavator 100, the boom 6, the arm 7, and the bucket 8 are operated simultaneously. In this case, the above-described control when the target speeds Vc_bm, Vc_am, and Vc_bkt of the boom 6, the arm 7, and the bucket 8 are input will be described below.

Figure 14:
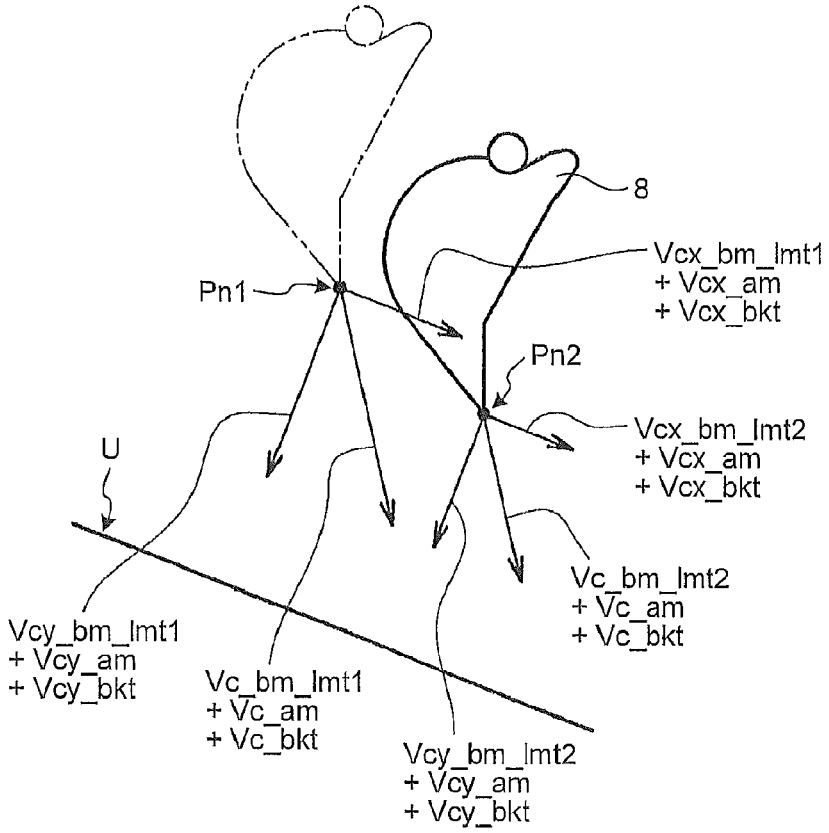
FIG. 14 is a diagram for describing an example of the limited excavation control.

FIG. 14 illustrates an example of a change in the speed limit of the boom 6 when the distance d between the target excavation landform U and the cutting edge 8*a* of the bucket 8 is smaller than the predetermined value dth1 and the cutting edge 8*a* of the bucket 8 moves from the position Pn1 to the position Pn2. The distance between the cutting edge 8*a* at the position Pn2 and the target excavation landform U is smaller than the distance between the cutting edge 8*a* at the position Pn1 and the target excavation landform U. For this reason, a limited vertical speed component Vcy_bm_lmt2 of the boom 6 at the position Pn2 is smaller than a limited vertical speed component Vcy_bm_lmt1 of the boom 6 at the position Pn1. Thus, a boom speed limit Vc_bm_lmt2 at the position Pn2 becomes smaller than a boom speed limit Vc_bm_lmt1 at the position Pn1. Moreover, a limited horizontal speed component Vcx_bm_lmt2 of the boom 6 at the position Pn2 becomes smaller than a limited horizontal speed component Vcx_bm_lmt1 of the boom 6 at the position Pn1. However, in this case, the arm target speed Vc_am and the bucket target speed Vc_bkt are not limited. For this reason, the vertical speed component Vcy_am and the horizontal speed component Vcx_am of the arm target speed and the vertical speed component Vcy_bkt and the horizontal speed component Vcx_bkt of the bucket target speed are not limited.

As described above, since no limitation is applied to the arm 7, a change in the amount of arm operation corresponding to the operator's intention to excavate is reflected as a change in the speed of the cutting edge 8*a* of the bucket 8. For this reason, the present embodiment can suppress the sense of incongruity during the excavation operation of the operator while suppressing expansion of a dug area of the target excavation landform U.

In this manner, in the present embodiment, the work machine controller 26 limits the speed of the boom 6 based on the target excavation landform U indicating the designed landform which is a target shape of an excavation object and the cutting edge position data S indicating the position of the cutting edge 8*a* of the bucket 8 so that a relative speed at which the bucket 8 approaches the target excavation landform U decreases according to the distance d between the target excavation landform U and the cutting edge 8*a* of the bucket 8. The work machine controller 26 determines the speed limit according to the distance d between the target excavation landform U and the cutting edge 8*a* of the bucket 8 based on the target excavation landform U indicating the designed landform which is a target shape of an excavation object and the cutting edge position data S indicating the position of the cutting edge 8*a* of the bucket 8 and controls the work machine 2 so that the speed in the direction in which the work machine 2 approaches the target excavation landform U is equal to or less than the speed limit. In this way, the limited excavation control on the cutting edge 8*a* is executed, the speed of the boom cylinder described later is adjusted, and the position of the cutting edge 8*a* with respect to the target excavation landform U is controlled.

In the following description, outputting the control signal to the control valve 27 connected to the boom cylinder 10 to control the position of the boom 6 so that digging of the cutting edge 8*a* into the target excavation landform U is suppressed is referred to as intervention control.

The intervention control is executed when the relative speed of the cutting edge 8*a* in the vertical direction with respect to the target excavation landform U is larger than the speed limit. The intervention control is not executed when the relative speed of the cutting edge 8*a* is smaller than the speed limit. The fact that the relative speed of the cutting edge 8*a* is smaller than the speed limit includes the fact that the bucket 8 moves with respect to the target excavation landform U so that the bucket 8 is separated from the target excavation landform U.

[Cylinder Stroke Sensor]

Figure 15:
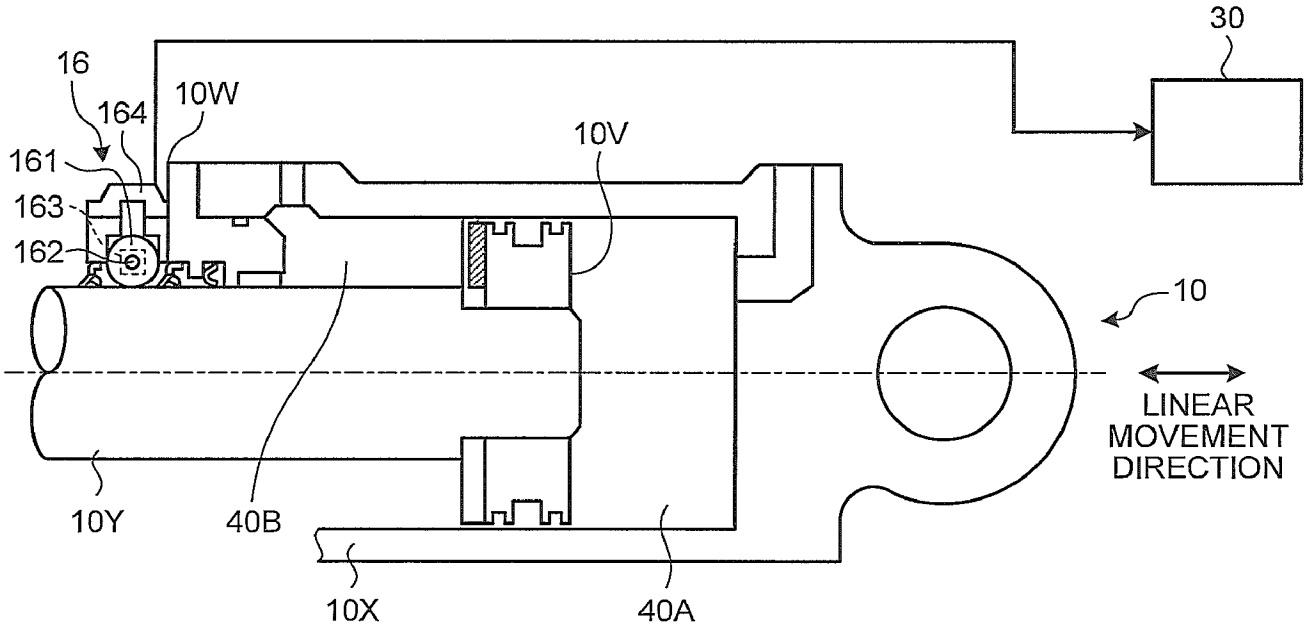
FIG. 15 is a diagram illustrating an example of a hydraulic cylinder.

Next, the cylinder stroke sensor 16 will be described with reference to FIGS. 15 and 16. In the following description, the cylinder stroke sensor 16 attached to the boom cylinder 10 will be described. The cylinder stroke sensor 17 and the like attached to the arm cylinder 11 have the same configuration as the cylinder stroke sensor 16.

The cylinder stroke sensor 16 is attached to the boom cylinder 10. The cylinder stroke sensor 16 measures the stroke of a piston. As illustrated in FIG. 15, the boom cylinder 10 includes a cylinder tube 10X and a cylinder rod 10Y capable of moving relative to the cylinder tube 10X within the cylinder tube 10X. A piston 10V is slidably provided in the cylinder tube 10X. The cylinder rod 10Y is attached to the piston 10V. The cylinder rod 10Y is slidably provided in a cylinder head 10W. A chamber defined by the cylinder head 10W, the piston 10V, and a cylinder inner wall is a rod-side oil chamber 40B. An oil chamber on the opposite side of the rod-side oil chamber 40B with the piston 10V interposed is a cap-side oil chamber 40A. In addition, a seal member is provided in the cylinder head 10W so as to seal the gap between the cylinder head and the cylinder rod 10Y so that dust or the like does not enter the rod-side oil chamber 40B.

The cylinder rod 10Y retracts when operating oil is supplied to the rod-side oil chamber 40B and the operating oil is discharged from the cap-side oil chamber 40A. Moreover, the cylinder rod 10Y extends when operating oil is discharged from the rod-side oil chamber 40B and the operating oil is supplied to the cap-side oil chamber 40A. That is, the cylinder rod 10Y moves linearly in the left-right direction in the figure.

A case 164 that covers the cylinder stroke sensor 16 and accommodates the cylinder stroke sensor 16 is provided at a location outside the rod-side oil chamber 40B in the proximity of the cylinder head 10W. The case 164 is fixed to the cylinder head 10W by being fastened to the cylinder head 10W by a bolt or the like.

The cylinder stroke sensor 16 includes a rotation roller 161, a rotation center shaft 162, and a rotation sensor portion 163. The rotation roller 161 has a surface in contact with the surface of the cylinder rod 10Y and is provided so as to rotate according to linear movement of the cylinder rod 10Y. That is, the linear movement of the cylinder rod 10Y is converted into rotational movement by the rotation roller 161. The rotation center shaft 162 is disposed so as to be orthogonal to the direction of the linear movement of the cylinder rod 10Y.

The rotation sensor portion 163 is configured to be capable of detecting the amount of rotation (rotation angle) of the rotation roller 161 as an electrical signal. The electrical signal indicating the amount of rotation (rotation angle) of the rotation roller 161 detected by the rotation sensor portion 163 is output to the sensor controller 30 via an electrical signal line. The sensor controller 30 converts the electrical signal into the position (stroke position) of the cylinder rod 10Y of the boom cylinder 10.

Figure 16:
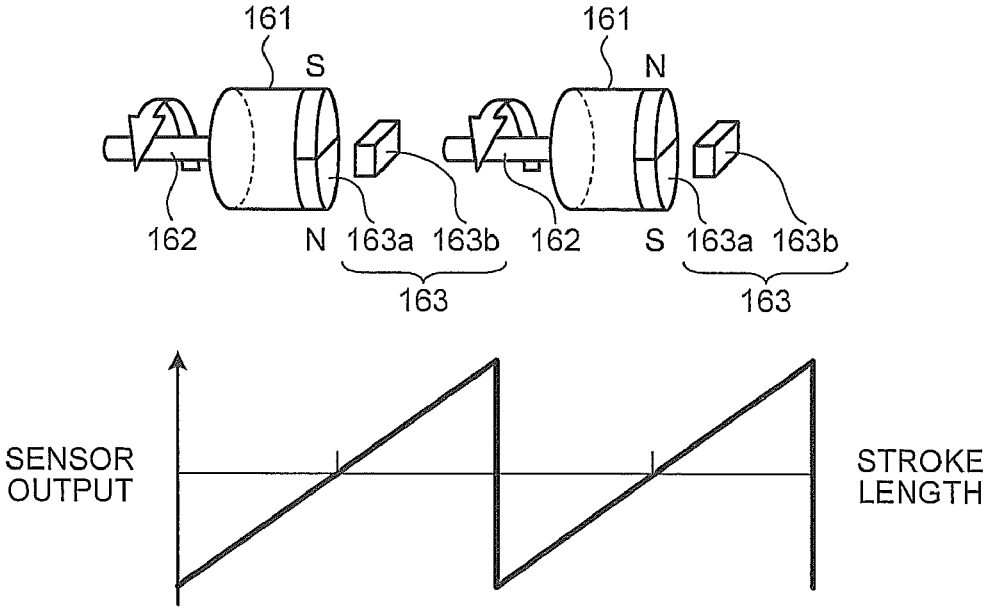
FIG. 16 is a diagram illustrating an example of a cylinder stroke sensor.

As illustrated in FIG. 16, the rotation sensor portion 163 includes a magnet 163*a* and a hall IC 163*b*. The magnet 163*a* which is a detecting medium is attached to the rotation roller 161 so as to rotate integrally with the rotation roller 161. The magnet 163*a* rotates according to rotation of the rotation roller 161 around the rotation center shaft 162. The magnet 163*a* is configured such that the N pole and the S pole alternate according to the rotation angle of the rotation roller 161. The magnet 163*a* is configured such that magnetic force (magnetic flux density) detected by the hall IC 163*b* changes periodically every rotation of the rotation roller 161.

The hall IC 163*b* is a magnetic force sensor that detects the magnetic force (magnetic flux density) generated by the magnet 163*a* as an electrical signal. The hall IC 163*b* is provided along the axial direction of the rotation center shaft 162 at a position separated by a predetermined distance from the magnet 163*a*.

The electrical signal (phase shift pulse) detected by the hall IC 163*b* is output to the sensor controller 30. The sensor controller 30 converts the electrical signal from the hall IC 163*b* into an amount of rotation of the rotation roller 161, that is, a displacement amount (boom cylinder length) of the cylinder rod 10Y of the boom cylinder 10.

Here, the relation between the rotation angle of the rotation roller 161 and the electrical signal (voltage) detected by the hall IC 163*b* will be described with reference to FIG. 16. When the rotation roller 161 rotates and the magnet 163*a* rotates according to the rotation of the rotation roller 161, the magnetic force (magnetic flux density) that passes through the hall IC 163*b* changes periodically according to the rotation angle and the electrical signal (voltage) which is the sensor output changes periodically. The rotation angle of the rotation roller 161 can be measured from the magnitude of the voltage output from the hall IC 163*b*.

Moreover, by counting the number of repetitions of one cycle of the electrical signal (voltage) output from the hall IC 163*b*, it is possible to measure the number of rotations of the rotation roller 161. Then, the displacement amount (boom cylinder length) of the cylinder rod 10Y of the boom cylinder 10 is calculated based on the rotation angle of the rotation roller 161 and the number of rotations of the rotation roller 161.

Moreover, the sensor controller 30 can calculate the moving speed (cylinder speed) of the cylinder rod 10Y based on the rotation angle of the rotation roller 161 and the number of rotations of the rotation roller 161.

[Hydraulic Cylinder]

Next, the hydraulic cylinder according to the present embodiment will be described. The boom cylinder 10, the arm cylinder 11, and the bucket cylinder 12 are hydraulic cylinders. In the following description, the boom cylinder 10, the arm cylinder 11, and the bucket cylinder 12 will be appropriately collectively referred to as a hydraulic cylinder 60.

Figure 17:
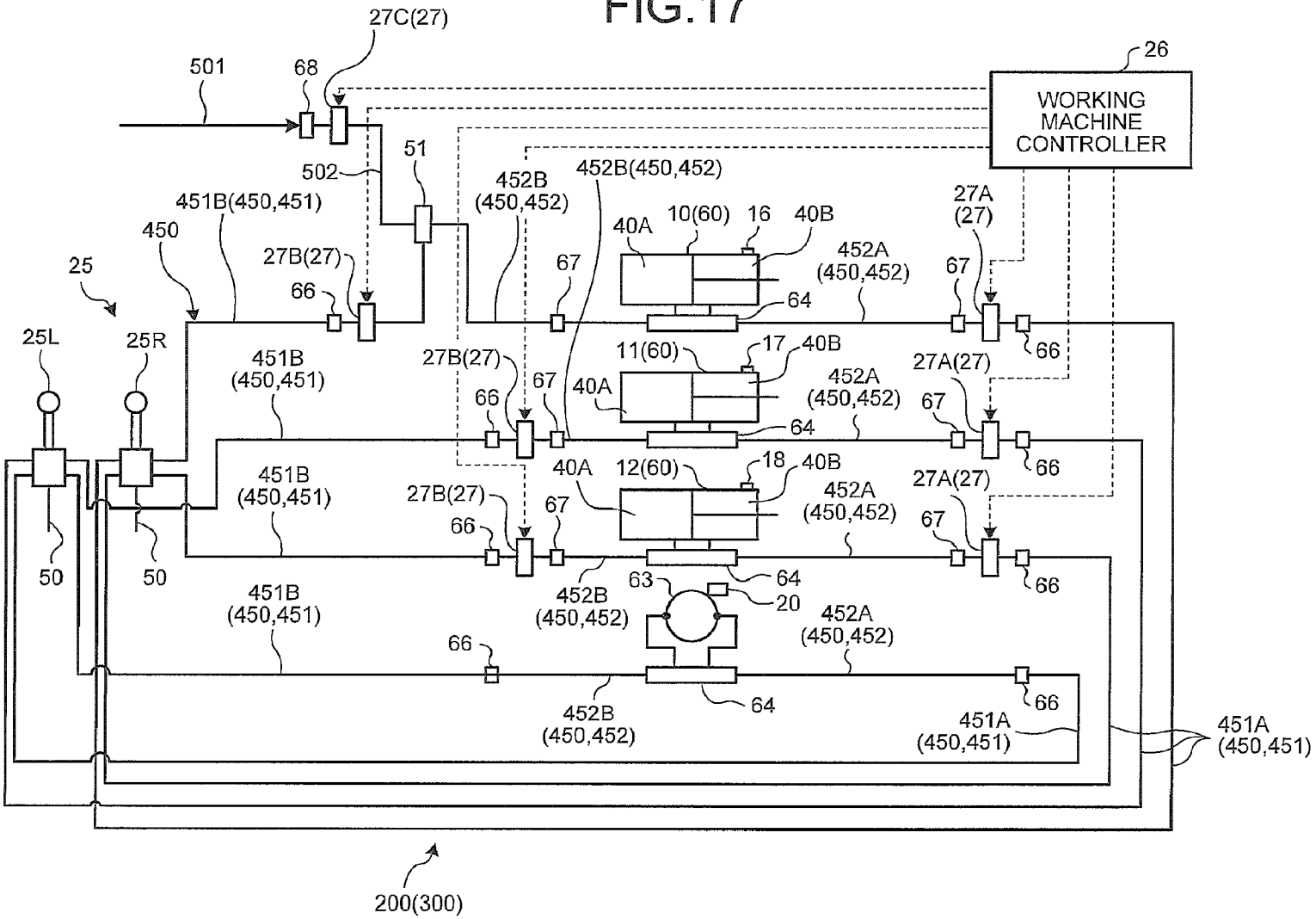
FIG. 17 is a diagram illustrating an example of a control system.
Figure 18:
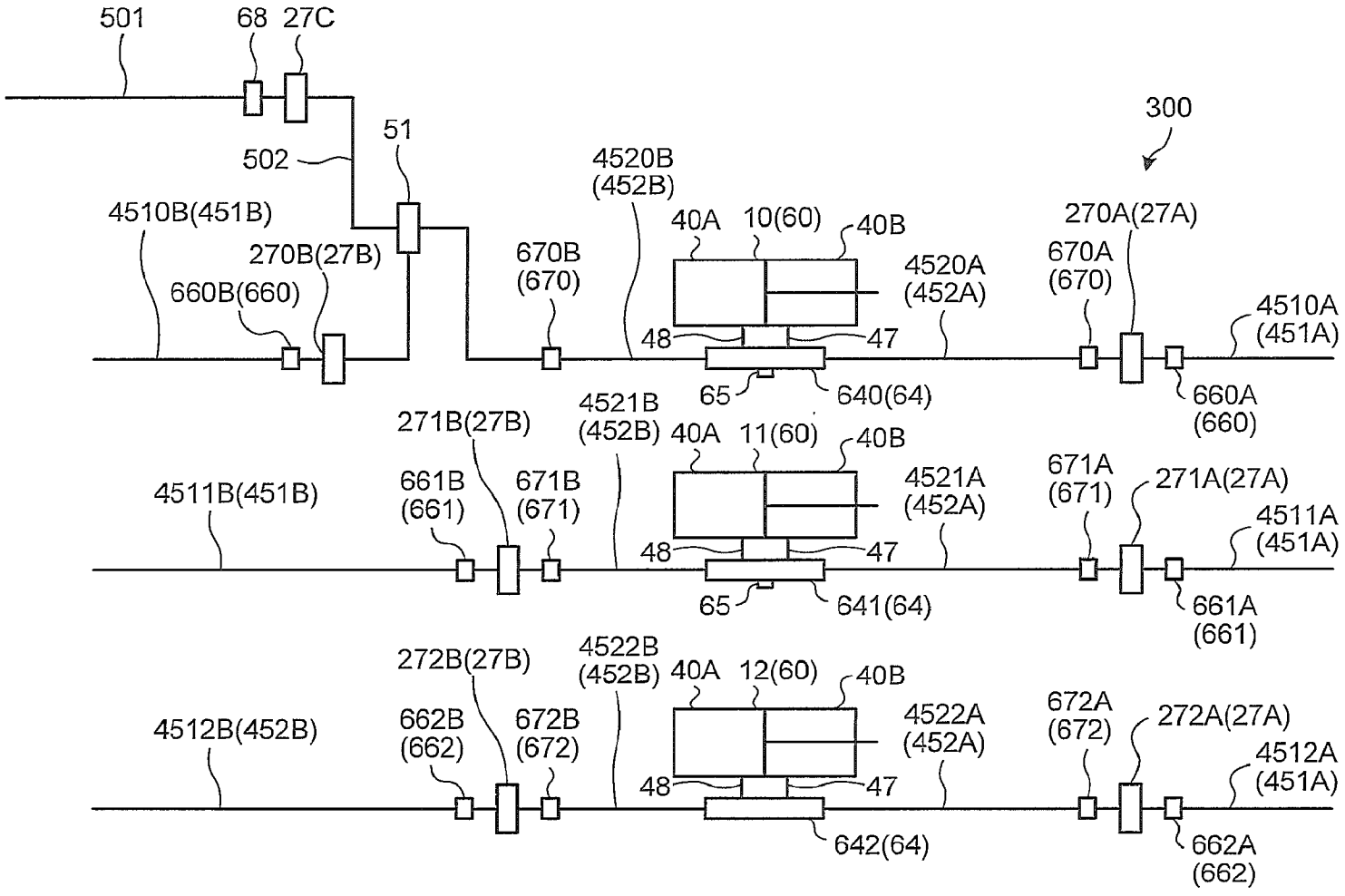
FIG. 18 is a diagram illustrating an example of the control system.

FIG. 17 is a schematic diagram illustrating an example of the control system 200 according to the present embodiment. FIG. 18 is an enlarged view of a portion of FIG. 17.

As illustrated in FIGS. 17 and 18, a hydraulic system 300 includes the hydraulic cylinder 60 including the boom cylinder 10, the arm cylinder 11, and the bucket cylinder 12 and a swinging motor 63 that swings the swinging structure 3. The hydraulic cylinder 60 operates with operating oil supplied from the main hydraulic pump. The swinging motor 63 is a hydraulic motor and operates with operating oil supplied from the main hydraulic pump.

In the present embodiment, the direction control valve 64 that controls the direction in which the operating oil flows is provided. The operating oil supplied from the main hydraulic pump is supplied to the hydraulic cylinder 60 via the direction control valve 64. The direction control valve 64 is a spool-type valve in which a rod-shaped spool is moved to change the flowing direction of the operating oil. When the spool moves in the axial direction, the supply of the operating oil to the cap-side oil chamber 40A and the supply of the operating oil to the rod-side oil chamber 40B are switched. Moreover, when the spool moves in the axial direction, the amount (the amount of supply per unit time) of operating oil supplied to the hydraulic cylinder 60 is adjusted. When the amount of operating oil supplied to the hydraulic cylinder 60 is adjusted, the cylinder speed is adjusted.

A spool stroke sensor 65 that detects a movement distance (spool stroke) of the spool is provided in the direction control valve 64. A detection signal of the spool stroke sensor 65 is output to the work machine controller 26.

The driving of the direction control valve 64 is adjusted by the operating device 25. In the present embodiment, the operating device 25 is a pilot hydraulic-type operating device. Pilot oil which has been delivered from the main hydraulic pump and decompressed by the pressure-reducing valve is supplied to the operating device 25. In addition, the pilot oil which has been delivered from a pilot hydraulic pump different from the main hydraulic pump may be supplied to the operating device 25. The operating device 25 includes a pilot pressure adjustment valve. The pilot pressure is adjusted based on the amount of operation of the operating device 25. The direction control valve 64 is driven with the pilot pressure. When the pilot pressure is adjusted by the operating device 25, the movement amount and the moving speed of the spool in relation to the axial direction are adjusted.

The direction control valve 64 is provided in each of the boom cylinder 10, the arm cylinder 11, the bucket cylinder 12, and the swinging motor 63. In the following description, the direction control valve 64 connected to the boom cylinder 10 will be appropriately referred to as a direction control valve 640. The direction control valve 64 connected to the arm cylinder 11 will be appropriately referred to as a direction control valve 641. The direction control valve 64 connected to the bucket cylinder 12 will be appropriately referred to as a direction control valve 642.

The operating device 25 and the direction control valve 64 are connected by the pilot hydraulic line 450. In the present embodiment, the control valve 27, the pressure sensor 66, and the pressure sensor 67 are disposed on the pilot hydraulic lines 450.

In the following description, among the pilot hydraulic lines 450, the pilot hydraulic line 450 between the operating device 25 and the control valve 27 will be appropriately referred to as an oil passage 451, and the pilot hydraulic line 450 between the control valve 27 and the direction control valve 64 will be appropriately referred to as an oil passage 452.

The oil passage 452 is connected to the direction control valve 64. The pilot oil is supplied to the direction control valve 64 through the oil passage 452. The direction control valve 64 includes a first pressure receiving chamber and a second pressure receiving chamber. The oil passage 452 includes an oil passage 452A connected to the first pressure receiving chamber and an oil passage 452B connected to the second pressure receiving chamber.

When the pilot oil is supplied to the second pressure receiving chamber of the direction control valve 64 through the oil passage 452B, the spool moves according to the pilot pressure, and the operating oil is supplied to the cap-side oil chamber 40A via the direction control valve 64. The amount of operating oil supplied to the cap-side oil chamber 40A is adjusted by the amount of operation (movement amount of the spool) of the operating device 25.

When the pilot oil is supplied to the first pressure receiving chamber of the direction control valve 64 through the oil passage 452A, the spool moves according to the pilot pressure, and the operating oil is supplied to the rod-side oil chamber 40B via the direction control valve 64. The amount of operating oil supplied to the rod-side oil chamber 40B is adjusted by the amount of operation (movement amount of the spool) of the operating device 25.

That is, when pilot oil of which the pilot pressure is adjusted by the operating device 25 is supplied to the direction control valve 64, the spool moves to one side in relation to the axial direction. When pilot oil of which the pilot pressure is adjusted by the operating device 25 is supplied to the direction control valve 64, the spool moves to the other side in relation to the axial direction. In this way, the position of the spool in relation to the axial direction is adjusted.

The oil passage 451 includes an oil passage 451A that connects the oil passage 452A and the operating device 25 and an oil passage 451B that connects the oil passage 452B and the operating device 25.

In the following description, the oil passage 452A connected to the direction control valve 640 via which the operating oil is supplied to the boom cylinder 10 will be appropriately referred to as an oil passage 4520A, and the oil passage 452B connected to the direction control valve 640 will be appropriately referred to as an oil passage 4520B. The oil passage 452A connected to the direction control valve 641 via which the operating oil is supplied to the arm cylinder 11 will be appropriately referred to as an oil passage 4521A, and the oil passage 452B connected to the direction control valve 641 will be appropriately referred to as an oil passage 4521B. The oil passage 452A connected to the direction control valve 642 via which the operating oil is supplied to the bucket cylinder 12 will be appropriately referred to as an oil passage 4522A, and the oil passage 452B connected to the direction control valve 642 will be appropriately referred to as an oil passage 4522B.

In the following description, the oil passage 451A connected to an oil passage 4520A will be referred to as an oil passage 4510A, and the oil passage 451B connected to the oil passage 4520B will be referred to as an oil passage 4510B. The oil passage 451A connected to the oil passage 4521A will be referred to as an oil passage 4511A, and the oil passage 451B connected to the oil passage 4521B will be referred to as an oil passage 4511B. The oil passage 451A connected to the oil passage 4522A will be referred to as an oil passage 4512A, and the oil passage 451B connected to the oil passage 4522B will be referred to as an oil passage 4512B.

As described above, according to the operation of the operating device 25, the boom 6 executes two types of operations of the lowering operation and the raising operation. When the operating device 25 is operated so that the raising operation of the boom 6 is executed, the pilot oil is supplied to the direction control valve 640 connected to the boom cylinder 10 through the oil passage 4510B and the oil passage 4520B. The direction control valve 640 operates based on the pilot pressure. In this way, the operating oil from the main hydraulic pump is supplied to the boom cylinder 10, and the raising operation of the boom 6 is executed. When the operating device 25 is operated so that the lowering operation of the boom 6 is executed the pilot oil is supplied to the direction control valve 640 connected to the boom cylinder 10 through the oil passage 4510A and the oil passage 4520A. The direction control valve 640 operates based on the pilot pressure. In this way, the operating oil from the main hydraulic pump is supplied to the boom cylinder 10, and the lowering operation of the boom 6 is executed.

Moreover, according to the operation of the operating device 25, the arm 7 executes two types of operations of the lowering operation and the raising operation. When the operating device 25 is operated so that the lowering operation of the arm 7 is executed, the pilot oil is supplied to the direction control valve 641 connected to the arm cylinder 11 through the oil passage 4511B and the oil passage 4521B. The direction control valve 641 operates based on the pilot pressure. In this way, the operating oil from the main hydraulic pump is supplied to the arm cylinder 11, and the lowering operation of the arm 7 is executed. When the operating device 25 is operated so that the raising operation of the arm 7 is executed, the pilot oil is supplied to the direction control valve 641 connected to the arm cylinder 11 through the oil passage 4511A and the oil passage 4521A. The direction control valve 641 operates based on the pilot pressure. In this way, the operating oil from the main hydraulic pump is supplied to the arm cylinder 11, and the raising operation of the arm 7 is executed.

Moreover, according to the operation of the operating device 25, the bucket 8 executes two types of operations of the lowering operation and the raising operation. When the operating device 25 is operated so that the lowering operation of the bucket 8 is executed, the pilot oil is supplied to the direction control valve 642 connected to the bucket cylinder 12 through the oil passage 4512B and the oil passage 4522B. The direction control valve 642 operates based on the pilot pressure. In this way, the operating oil from the main hydraulic pump is supplied to the bucket cylinder 12, and the lowering operation of the bucket 8 is executed. When the operating device 25 is operated so that the raising operation of the bucket 8 is executed, the pilot oil is supplied to the direction control valve 642 connected to the bucket cylinder 12 through the oil passage 4512A and the oil passage 4522A. The direction control valve 642 operates based on the pilot pressure. In this way, the operating oil from the main hydraulic pump is supplied to the bucket cylinder 12, and the raising operation of the bucket 8 is executed.

Moreover, according to the operation of the operating device 25, the swinging structure 3 executes two types of operations of the right swinging operation and the left swinging operation. When the operating device 25 is operated so that the right swinging operation of the swinging structure 3 is executed, operating oil is supplied to the swinging motor 63. When the operating device 25 is operated so that the left swinging operation of the swinging structure 3 is executed, the operating oil is supplied to the swinging motor 63.

In the present invention, the boom 6 is raised when the boom cylinder 10 is extended, and the boom 6 is lowered when the boom cylinder 10 is retracted. In other words, when the operating oil is supplied to the cap-side oil chamber 40A of the boom cylinder 10, the boom cylinder 10 is extended, and the boom 6 is raised. When the operating oil is supplied to the rod-side oil chamber 40B of the boom cylinder 10, the boom cylinder 10 is retracted, and the boom 6 is lowered.

In the present invention, the arm 7 is lowered (performs an excavating operation) when the arm cylinder 11 is extended, and the arm 7 is raised (performs a dumping operation) when the arm cylinder 11 is retracted. In other words, when the operating oil is supplied to the cap-side oil chamber 40A of the arm cylinder 11, the arm cylinder 11 is extended, and the arm 7 is lowered. When the operating oil is supplied to the rod-side oil chamber 40B of the arm cylinder 11, the arm cylinder 11 is retracted, and the arm 7 is raised.

In the present invention, the bucket 8 is lowered (performs an excavating operation) when the bucket cylinder 12 is extended, and the bucket 8 is raised (performs a dumping operation) when the bucket cylinder 12 is retracted. In other words, when the operating oil is supplied to the cap-side oil chamber 40A of the bucket cylinder 12, the bucket cylinder 12 is extended, and the bucket 8 is lowered. When the operating oil is supplied to the rod-side oil chamber 40B of the bucket cylinder 12, the bucket cylinder 12 is retracted, and the bucket 8 is raised.

The control valve 27 adjusts pilot pressure based on the control signal (EPC current) from the work machine controller 26. The control valve 27 is an electromagnetic proportional control valve and is controlled based on the control signal from the work machine controller 26. The control valve 27 includes a control valve 27B capable of adjusting the pilot pressure of the pilot oil supplied to the second pressure receiving chamber of the direction control valve 64 to adjust the amount of operating oil supplied to the cap-side oil chamber 40A via the direction control valve 64 and a control valve 27A capable of adjusting the pilot pressure of the pilot oil supplied to the first pressure receiving chamber of the direction control valve 64 to adjust the amount of operating oil supplied to the rod-side oil chamber 40B via the direction control valve 64.

The pressure sensors 66 and 67 that detect the pilot pressure are provided on both sides of the control valve 27.

In the present embodiment, the pressure sensor 66 is disposed in the oil passage 451 between the operating device 25 and the control valve 27. The pressure sensor 67 is disposed in the oil passage 452 between the control valve 27 and the direction control valve 64. The pressure sensor 66 is capable of detecting the pilot pressure before being adjusted by the control valve 27. The pressure sensor 67 is capable of detecting the pilot pressure adjusted by the control valve 27. The detection results of the pressure sensors 66 and 67 are output to the work machine controller 26.

In the following description, the control valve 27 capable of adjusting the pilot pressure of the pilot oil to the direction control valve 640 via which the operating oil is supplied to the boom cylinder 10 will be appropriately referred to as a control valve 270. Moreover, among the control valves 270, one control valve (corresponding to the control valve 27A) will be appropriately referred to as a control valve 270A, and the other control valve (corresponding to the control valve 27B) will be appropriately referred to as a control valve 270B. The control valve 27 capable of adjusting the pilot pressure of the pilot oil to the direction control valve 641 via which the operating oil is supplied to the arm cylinder 11 will be appropriately referred to as a control valve 271. Moreover, among the control valves 271, one control valve (corresponding to the control valve 27A) will be appropriately referred to as a control valve 271A, and the other control valve (corresponding to the control valve 27B) will be appropriately referred to as a control valve 271B. The control valve 27 capable of adjusting the pilot pressure to the direction control valve 642 via which the operating oil is supplied to the bucket cylinder 12 will be appropriately referred to as a control valve 272. Moreover, among the control valves 272, one control valve (corresponding to the control valve 27A) will be appropriately referred to as a control valve 272A, and the other control valve (corresponding to the control valve 27B) will be appropriately referred to as a control valve 272B.

In the following description, the pressure sensor 66 that detects the pilot pressure of the oil passage 451 connected to the direction control valve 640 via which the operating oil is supplied to the boom cylinder 10 will be appropriately referred to as a pressure sensor 660, and the pressure sensor 67 that detects the pilot pressure of the oil passage 452 connected to the direction control valve 640 will be appropriately referred to as a pressure sensor 670. Moreover, the pressure sensor 660 disposed in the oil passage 4510A will be appropriately referred to as a pressure sensor 660A, and the pressure sensor 660 disposed in the oil passage 4510B will be appropriately referred to as a pressure sensor 660B. Moreover, the pressure sensor 670 disposed in the oil passage 4520A will be appropriately referred to as a pressure sensor 670A, and the pressure sensor 670 disposed in the oil passage 4520B will be appropriately referred to as a pressure sensor 670B.

In the following description, the pressure sensor 66 that detects the pilot pressure of the oil passage 451 connected to the direction control valve 641 via which the operating oil is supplied to the arm cylinder 11 will be appropriately referred to as a pressure sensor 661, and the pressure sensor 67 that detects the pilot pressure of the oil passage 452 connected to the direction control valve 641 will be appropriately referred to as a pressure sensor 671. Moreover, the pressure sensor 661 disposed in the oil passage 4511A will be appropriately referred to as a pressure sensor 661A, and the pressure sensor 661 disposed in the oil passage 4511B will be appropriately referred to as a pressure sensor 661B. Moreover, the pressure sensor 671 disposed in the oil passage 4521A will be appropriately referred to as a pressure sensor 671A, and the pressure sensor 671 disposed in the oil passage 4521B will be appropriately referred to as a pressure sensor 671B.

In the following description, the pressure sensor 66 that detects the pilot pressure of the oil passage 451 connected to the direction control valve 642 via which the operating oil is supplied to the bucket cylinder 12 will be appropriately referred to as a pressure sensor 662, and the pressure sensor 67 that detects the pilot pressure of the oil passage 452 connected to the direction control valve 642 will be appropriately referred to as a pressure sensor 672. Moreover, the pressure sensor 662 disposed in the oil passage 4512A will be appropriately referred to as a pressure sensor 662A, and the pressure sensor 662 disposed in the oil passage 4512B will be appropriately referred to as a pressure sensor 662B. Moreover, the pressure sensor 672 disposed in the oil passage 4522A will be appropriately referred to as a pressure sensor 672A, and the pressure sensor 672 disposed in the oil passage 4522B will be appropriately referred to as a pressure sensor 672B.

When the limited excavation control is not executed, the work machine controller 26 controls the control valve 27 to open the pilot hydraulic line 450. When the pilot hydraulic line 450 is opened, the pilot pressure of the oil passage 451 becomes equal to the pilot pressure of the oil passage 452. In the state where the pilot hydraulic line 450 is opened, the pilot pressure is adjusted based on the amount of operation of the operating device 25.

In the limited excavation control or the like, when the work machine 2 is controlled by the work machine controller 26, the work machine controller 26 outputs the control signal to the control valve 27. The oil passage 451 has a predetermined pressure by the action of a pilot relief valve, for example. When the control signal is output from the work machine controller 26 to the control valve 27, the control valve 27 operates based on the control signal. The operating oil of the oil passage 451 is supplied to the oil passage 452 via the control valve 27. The pressure of the operating oil of the oil passage 452 is adjusted (reduced) by the control valve 27. The pressure of the operating oil of the oil passage 452 acts on the direction control valve 64. In this way, the direction control valve 64 operates based on the pilot pressure controlled by the control valve 27. In the present embodiment, the pressure sensor 66 detects the pilot pressure before being adjusted by the control valve 27. The pressure sensor 67 detects the pilot pressure after being adjusted by the control valve 27.

When the operating oil of which pressure is adjusted by the control valve 27A is supplied to the direction control valve 64, the spool moves to one side in relation to the axial direction. When the operating oil of which pressure is adjusted by the control valve 27B is supplied to the direction control valve 64, the spool moves to the other side in relation to the axial direction. In this way, the position of the spool in relation to the axial direction is adjusted.

For example, the work machine controller 26 can adjust the pilot pressure to the direction control valve 640 connected to the boom cylinder 10 by outputting the control signal to at least one of the control valves 270A and 270B.

Moreover, the work machine controller 26 can adjust the pilot pressure to the direction control valve 641 connected to the arm cylinder 11 by outputting the control signal to at least one of the control valves 271A and 271B.

Moreover, the work machine controller 26 can adjust the pilot pressure to the direction control valve 642 connected to the bucket cylinder 12 by outputting the control signal to at least one of the control valves 272A and 272B.

The work machine controller 26 limits the speed of the boom 6 based on the target excavation landform U indicating the designed landform which is a target shape of an excavation object and the bucket position data (cutting edge position data S) indicating the position of the bucket 8 so that a speed at which the bucket 8 approaches the target excavation landform U decreases according to the distance d between the target excavation landform U and the bucket 8. The work machine controller 26 includes a boom intervention unit that outputs a control signal for limiting the speed of the boom 6. In the present embodiment, when the work machine 2 is driven based on the operation of the operating device 25, the movement of the boom 6 is controlled (intervention control) based on the control signal output from the boom intervention unit of the work machine controller 26 so that the cutting edge 8*a* of the bucket 8 does not dig into the target excavation landform U. When the bucket 8 performs excavation, the raising operation of the boom 6 is executed by the work machine controller 26 so that the cutting edge 8*a* does not dig into the target excavation landform U.

In the present invention, an oil passage 502 is connected to the control valve 27C that operates based on an intervention control signal output from the work machine controller 26 in order to perform intervention control. An oil passage 501 is connected to the control valve 27C to supply the pilot oil which is to be supplied to the direction control valve 640 connected to the boom cylinder 10. The oil passage 502 is connected to the control valve 27C and the shuttle valve 51 and is connected to the oil passage 4520B connected to the direction control valve 640 via the shuttle valve 51.

The shuttle valve 51 has two inlet ports and one outlet port. The one inlet port is connected to an oil passage 50. The other inlet port is connected to the oil passage 4510B. The outlet port is connected to the oil passage 4520B. The shuttle valve 51 connects an oil passage having a higher pilot pressure among the oil passage 502 and the oil passage 4510B to the oil passage 4520B. For example, when the pilot pressure of the oil passage 502 is higher than the pilot pressure of the oil passage 4510B, the shuttle valve 51 operates so that the oil passage 502 and the oil passage 4520B are connected and the oil passage 4510B and the oil passage 4520B are not connected. In this way, the pilot oil of the oil passage 502 is supplied to the oil passage 4520B via the shuttle valve 51. When the pilot pressure of the oil passage 4510B is higher than the pilot pressure of the oil passage 502, the shuttle valve 51 operates so that the oil passage 4510B and the oil passage 4520B are connected and the oil passage 502 and the oil passage 4520B are not connected. In this way, the pilot oil of the oil passage 4510B is supplied to the oil passage 4520B via the shuttle valve 51.

The control valve 27C and a pressure sensor 68 that detects the pilot pressure of the pilot oil of the oil passage 501 are provided in the oil passage 501. The oil passage 501 includes an oil passage 501 through which the pilot oil before passing through the control valve 27C flows and an oil passage 502 through which the pilot oil after having passed through the control valve 27C flows. The control valve 27C is controlled based on the control signal output from the work machine controller 26 in order to execute the intervention control.

When the intervention control is not executed, the work machine controller 26 does not output the control signal to the control valve 27C so that the direction control valve 64 is driven based on the pilot pressure adjusted by the operation of the operating device 25. For example, the work machine controller 26 fully opens the control valve 270B and also closes the oil passage 50 by the control valve 27C so that the direction control valve 640 is driven based on the pilot pressure adjusted by the operation of the operating device 25.

When the intervention control is executed, the work machine controller 26 controls each control valve 27 so that the direction control valve 64 is driven based on the pilot pressure adjusted by the control valve 27C. For example, when the intervention control of limiting the movement of the boom 6 is executed, the work machine controller 26 controls the control valve 27C so that the pilot pressure adjusted by the control valve 27C is higher than the pilot pressure adjusted by the operating device 25. In this way, the pilot oil from the control valve 27C is supplied to the direction control valve 640 via the shuttle valve 51.

When the boom 6 is raised at a high speed by the operating device 25 so that the bucket 8 does not dig into the target excavation landform U, the intervention control is not executed. When the operating device 25 is operated so that the boom 6 is raised at a high speed and the pilot pressure is adjusted based on the amount of operation of the operating device, the pilot pressure to be adjusted by the operating device 25 becomes higher than the pilot pressure to be adjusted by the control valve 27C. In this way, the pilot oil of which pilot pressure has been adjusted by the operating device 25 is supplied to the direction control valve 640 via the shuttle valve 51.

Figure 19:
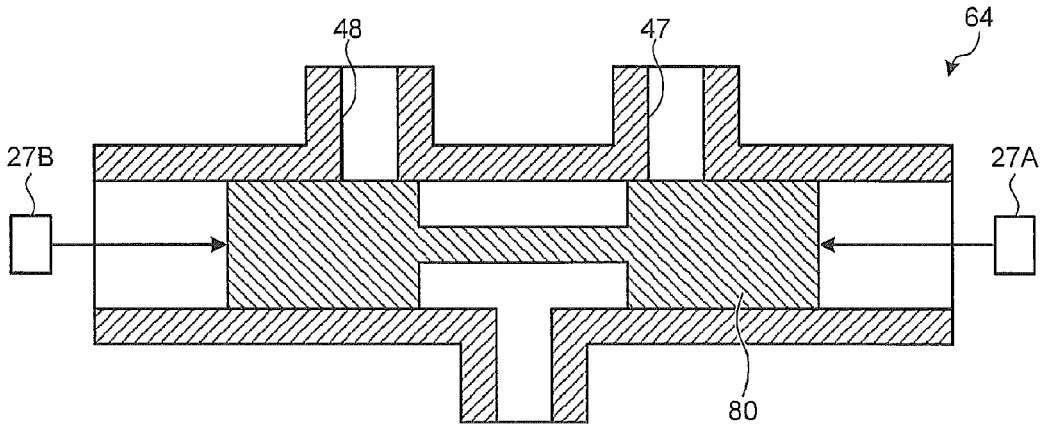
FIG. 19 is a diagram for describing an example of the operation of the construction machine.
Figure 20:
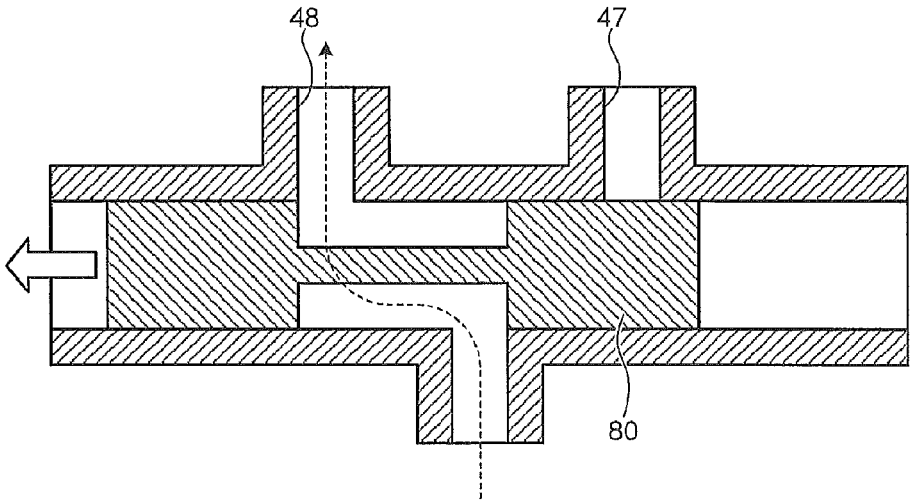
FIG. 20 is a diagram for describing an example of the operation of the construction machine.
Figure 21:
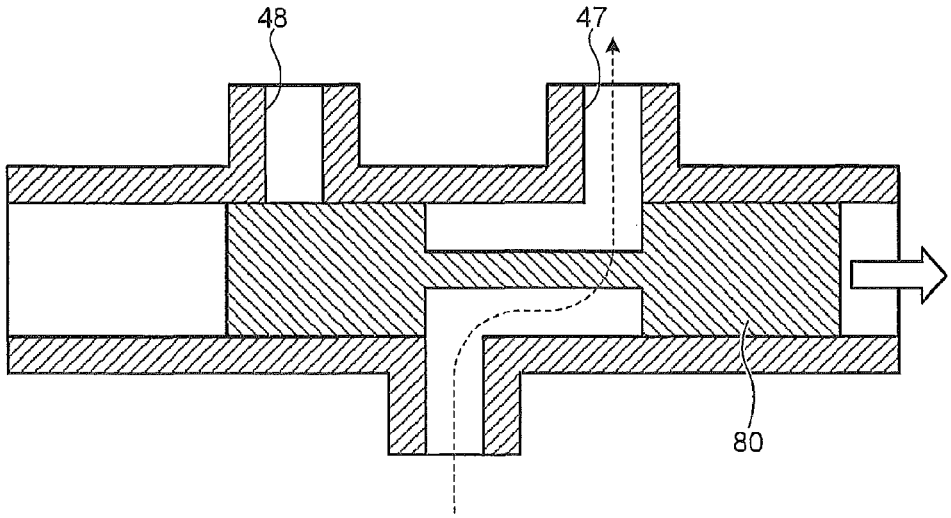
FIG. 21 is a diagram for describing an example of the operation of the construction machine.

FIG. 19 is a diagram schematically illustrating an example of the direction control valve 64. The direction control valve 64 controls the direction in which operating oil flows. The direction control valve 64 is a spool-type valve in which a rod-shaped spool 80 is moved to change the flowing direction of the operating oil. As illustrated in FIGS. 20 and 21, when the spool 80 moves in the axial direction, the supply of the operating oil to the cap-side oil chamber 40A and the supply of the operating oil to the rod-side oil chamber 40B are switched. FIG. 20 illustrates a state where the spool 80 is moved so that the operating oil is supplied to the cap-side oil chamber 40A. FIG. 21 illustrates a state where the spool 80 is moved so that the operating oil is supplied to the rod-side oil chamber 40B.

Moreover, when the spool 80 moves in the axial direction, the amount (the amount of supply per unit time) of the operating oil supplied to the hydraulic cylinder 60 is adjusted. As illustrated in FIG. 19, when the spool 80 is present at an initial position (origin), the operating oil is not supplied to the hydraulic cylinder 60. When the spool 80 moved in relation to the axial direction from the origin, the amount of operating oil corresponding to the movement amount of the spool is supplied to the hydraulic cylinder 60. When the amount of operating oil supplied to the hydraulic cylinder 60 is adjusted, the cylinder speed is adjusted.

When the pilot oil of which pressure is adjusted by the operating device 25 or the control valve 27A is supplied to the direction control valve 64, the spool 80 moves to one side in relation to the axial direction. When the pilot oil of which pressure is adjusted by the operating device 25 or the control valve 27B is supplied to the direction control valve 64, the spool 80 moves to the other side in relation to the axial direction. In this way, the position of the spool in relation to the axial direction is adjusted.

Figure 22:
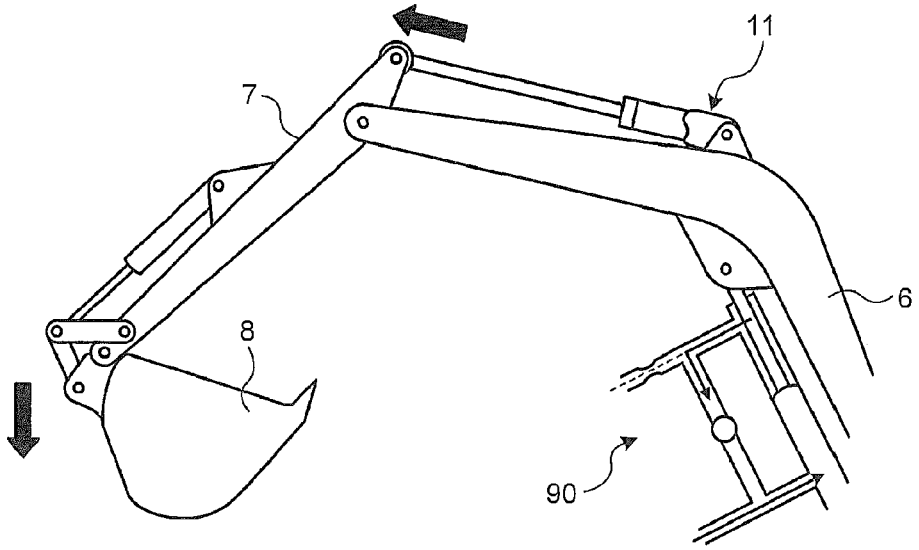
FIG. 22 is a diagram for describing an example of an operation of the construction machine.

FIG. 22 is a diagram illustrating an example of the hydraulic cylinder 60 according to the embodiment. In the present embodiment, a recycling circuit 90 is provided to the hydraulic cylinder 60 (boom cylinder 10). The recycling circuit 90 increases the moving speed of the boom 6 by recycling (returning) a portion of a returning oil from the rod side (bottom side) of the boom cylinder 10 to the cap side by using the load pressure according to the weight of the boom 6. In this way, during the lowering operation of the boom 6, the moving speed of the boom 6 (cylinder speed of the boom cylinder 10) is increased.

[Control System]

Figure 23:
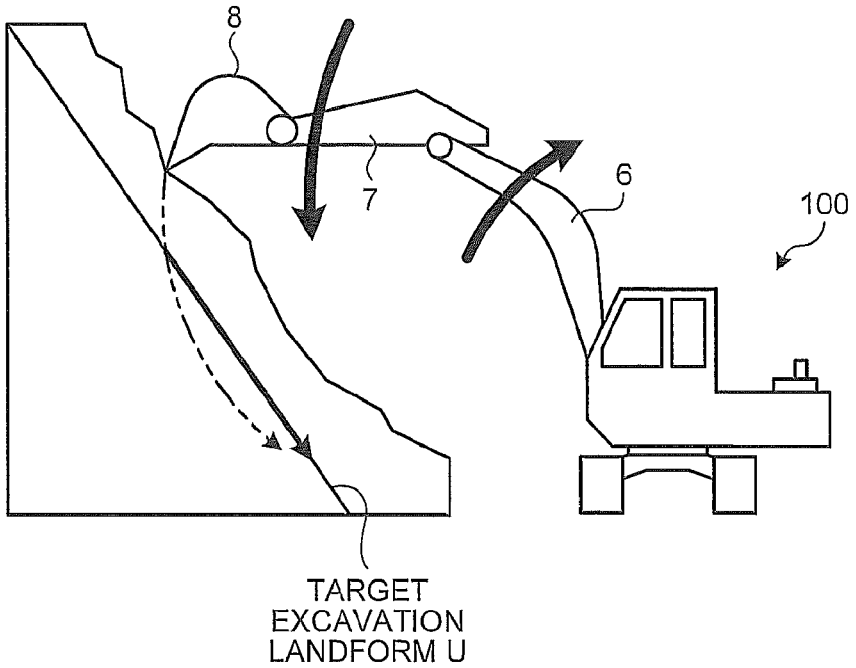
FIG. 23 is a schematic diagram illustrating an example of an operation of the construction machine.

FIG. 23 is a diagram schematically illustrating an example of an operation of the work machine 2 when the limited excavation control is performed. As described above, the hydraulic system 300 includes the boom cylinder 10 for driving the boom 6, the arm cylinder 11 for driving the arm 7, and the bucket cylinder 12 for driving the bucket 8.

As illustrated in FIG. 23, in the excavation according to the excavating operation of the arm 7, a hydraulic system 300 is operated so that the boom 6 is raised and the arm 7 is lowered. In the limited excavation control, the intervention control including the raising operation of the boom 6 is executed so that the bucket 8 does not dig into the designed landform.

The bucket 8 is replaceably installed to the arm 7. For example, the type of the bucket 8 is appropriately selected according to the content of the excavation work and the selected bucket 8 is connected to the arm 7.

If the type of the bucket 8 is different, in many cases, the weight of the bucket 8 is different. When the bucket 8 having a different weight is connected to the arm 7, the load acting on the hydraulic cylinder 60 that drives the work machine 2 changes, and the cylinder speed corresponding to the movement amount of the spool of the direction control valve changes. Therefore, the control error of the intervention control including the boom raising operation increases, so that the intervention control may not be performed with high accuracy. As a result, the bucket 8 may be unable to move based on the designed landform data U, and the excavation accuracy may decrease.

In the present invention, a plurality of pieces of first correlation data indicating the relation between the cylinder speed of the hydraulic cylinder 60 and the movement amount of the spool 80 of the direction control valve 64 according to the type of the bucket 8 is obtained in advance. The work machine controller 26 controls the movement amount of the spool 80 of the direction control valve 64 based on the first correlation data.

Figure 24:
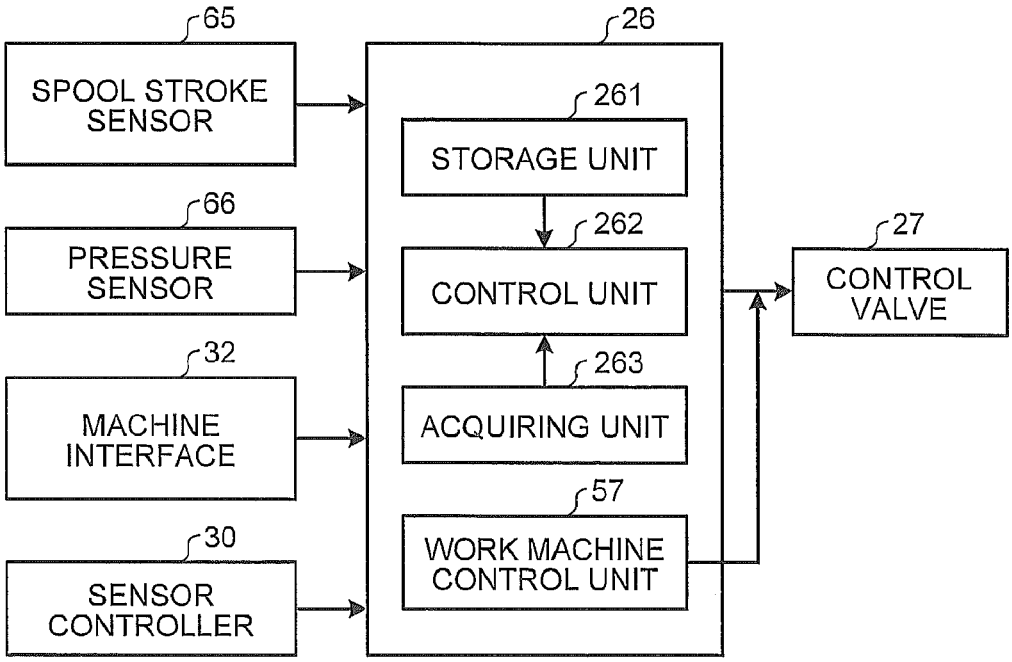
FIG. 24 is a functional block diagram illustrating an example of the control system.
Figure 25:
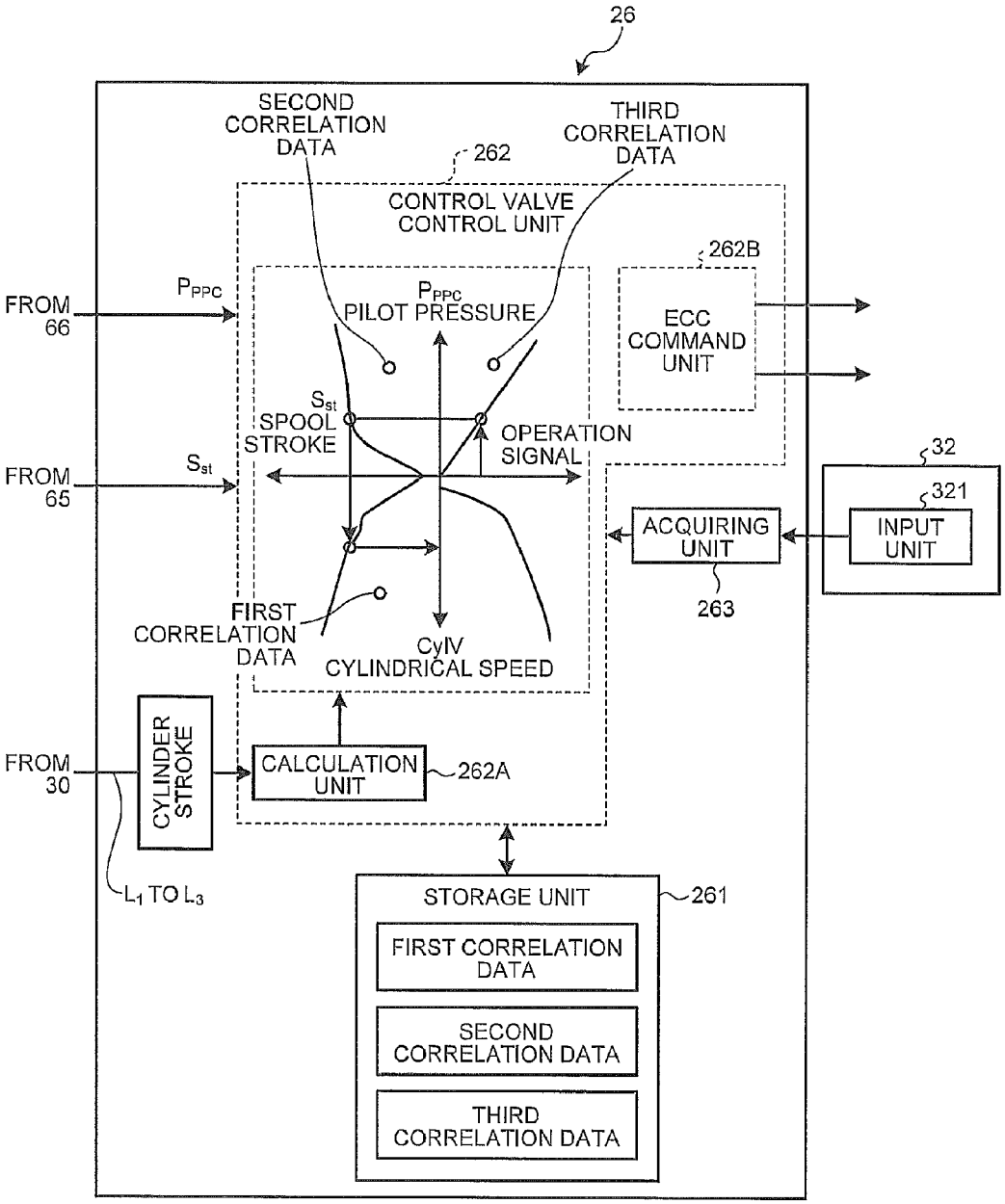
FIG. 25 is a functional block diagram illustrating an example of the control system.

FIGS. 24 and 25 are functional block diagrams illustrating an example of the control system 200 according to the present embodiment. As illustrated in FIGS. 24 and 25, the control system 200 includes the pressure sensor 66 that detects the amounts of operation MB, MA, and MT when the operating device 25 is operated, the work machine controller 26, and the control valve 27. The work machine controller 26 includes a storage unit 261, a control valve control unit 262, an acquiring unit 263, and the work machine control unit 57.

The work machine controller 26 includes the storage unit 261 that stores a plurality of pieces of the first correlation data indicating the relation between the cylinder speed of the hydraulic cylinder 60 and the movement amount of the spool 80 of the direction control valve 64 according to the weight of the bucket 8, the acquiring unit 263 that acquires weight data indicating the weight of the bucket 8, and the control valve control unit 262 that selects one piece of the first correlation data from the plurality of pieces of the first correlation data based on the weight data and determines characteristics of performing a command on the control valve 27 based on the selected first correlation data.

The cylinder speed of the hydraulic cylinder 60 is adjusted based on the amount of supply of the operating oil supplied per unit time from the main hydraulic pump via the direction control valve 64. The direction control valve 64 has a movable spool 80. The amount of operating oil supplied per unit time to the hydraulic cylinder 60 is adjusted based on the movement amount of the spool 80. In the present embodiment, the direction control valve 64 functions as an adjusting device that is capable of adjusting the amount of operating oil supplied to the hydraulic cylinder 60 that drives the work machine 2 by the movement of the spool 80.

The movement amount of the spool 80 is adjusted by the pressure (pilot pressure) of the oil passage 452 which is controlled by the operating device 25 or the control valve 27. The pilot pressure of the oil passage 452 is pressure of the pilot oil of the oil passage 452 for moving the spool and is adjusted by the operating device 25 or the control valve 27. The control valve 27 operates based on the control signal (EPC current) output from the control valve control unit 262 of the work machine controller 26. In the following description, the pressure of the pilot oil for moving the spool 80, which is controlled by the control valve 27, will be referred to as PPC pressure.

That is, the cylinder speed and the movement amount of the spool are correlated with each other. The movement amount of the spool and the PPC pressure are correlated with each other. The PPC pressure and the EPC current are correlated with each other.

In FIG. 24, the acquiring unit 263 acquires type data indicating the type of the bucket 8. In the present embodiment, the type data is weight data indicating the weight of the bucket 8. In the present embodiment, the man machine interface 32 is provided to the cab 4. The man machine interface 32 includes an input unit 321 in relation to selection of the bucket 8. In the present embodiment, the type data includes information on the weight of the bucket 8 selected by the man machine interface 32, and the input unit 321 includes a first input unit that indicates "large" when the bucket 8 has a large weight, a second input unit that indicates "small" when the bucket 8 has a small weight, and a third input unit that indicates "middle" when the bucket 8 has a middle weight between the large weight and the small weight. The input unit corresponding to the weight of the bucket 8 is selected among the first input unit, the second input unit, and the third input unit based on the bucket 8 connected to the arm 7. The operator operates the input unit indicating "large" when the large-weight bucket 8 is connected to the arm 7, the operator operates the input unit indicating "middle" when the middle-weight bucket 8 is connected to the arm 7, and the operator operates the input unit indicating "small" when the small-weight bucket 8 is connected to the arm 7. In addition, an input device may include a numerical value input unit that is capable to inputting a value of the weight of the bucket 8.

FIG. 25 is a block diagram describing FIG. 24 according to the present invention in detail. The work machine controller 26 includes the storage unit 261, the control valve control unit 262, and a calculation unit 263. As described above, the cylinder speed and the movement amount (spool stroke) of the spool 80 are correlated with each other. The movement amount of the spool 80 and the PPC pressure are correlated with each other. The PPC pressure and the EPC current are correlated with each other. As illustrated in FIG. 25, the storage unit 261 stores, as data defining the cylinder speed according to the weight of the bucket 8 and the characteristics corresponding to the operation command, a plurality of pieces of first correlation data indicating the relation between the cylinder speed of the hydraulic cylinder 60 and the movement amount of the spool 80, second correlation data indicating the relation between the movement amount of the spool 80 and the PPC pressure controlled by the control valve 27, and third correlation data indicating the relation between the PPC pressure and the control signal (EPC current) output from the control valve control unit 262. The first correlation data, the second correlation data, and the third correlation data may be obtained through experiments or simulation and stored in the storage unit 261 in advance.

The control valve control unit 262 includes a calculation unit 262A and an EPC command unit 262B. The control valve control unit 262 acquires the relation between an amount of operation of the lever and the cylinder speed based on the correlation data 1 to 3 acquired from the storage unit. The EPC command unit 262B outputs a command value of outputting a command to the control valve 27 (27A, 27B, 27C) based on the acquired correlation data 1 to 3.

When the man machine interface 32 is operated by the operator, the input signal generated by the input unit 321 is output to the acquiring unit 263. The acquiring unit 263 acquires weight data indicating the weight of the bucket 8 connected to the arm 7 based on the input signal. The control valve control unit 262 acquires the correlation data 1 to 3 from the storage unit 261 based on the weight of the bucket 8 acquired by the acquiring unit 263. The EPC command unit 262B outputs the command value of outputting the command to the control valve 27 (27A, 27B, 27C) based on the acquired correlation data 1 to 3.

In addition, the first correlation data may be obtained by the operator's work. When the bucket 8 having a weight is connected to the arm 7, the operating device 25 is operated so that the spool 80 moves by a predetermined amount. The movement amount (movement distance) of the spool 80 can be detected by the spool stroke sensor 65. Moreover, the cylinder speed according to the movement amount of the spool 80 is calculated by the calculation unit 262A based on cylinder lengths L1 to L3 which are detected by the cylinder stroke sensor (16 and the like) and derived by the sensor controller 30 and measurement time. In the present invention, as described with reference to FIGS. 15 and 16 and the like, the cylinder stroke sensor 16 can detect a speed (cylinder speed) of the cylinder rod 10Y with high accuracy. The control valve control unit 262 may acquire the first correlation data based on the detection result of the spool stroke sensor 65 and the detection result of the cylinder stroke sensor (16 and the like). Moreover, the control valve control unit 262 may acquire the second correlation data from the detection result of the spool stroke sensor 65 and the data of the amount of operation of the pressure sensor 66. Similarly, the control valve control unit 262 may acquire the third correlation data from the relation between the data of the amount of operation of the pressure sensor and the control signal to the control valve 27.

The cylinder speed changes according to the type (weight) of the bucket 8. For example, even if the same amount of operating oil is supplied to the hydraulic cylinder 60, when the weight of the bucket 8 changes, the cylinder speed changes.

Figure 26:
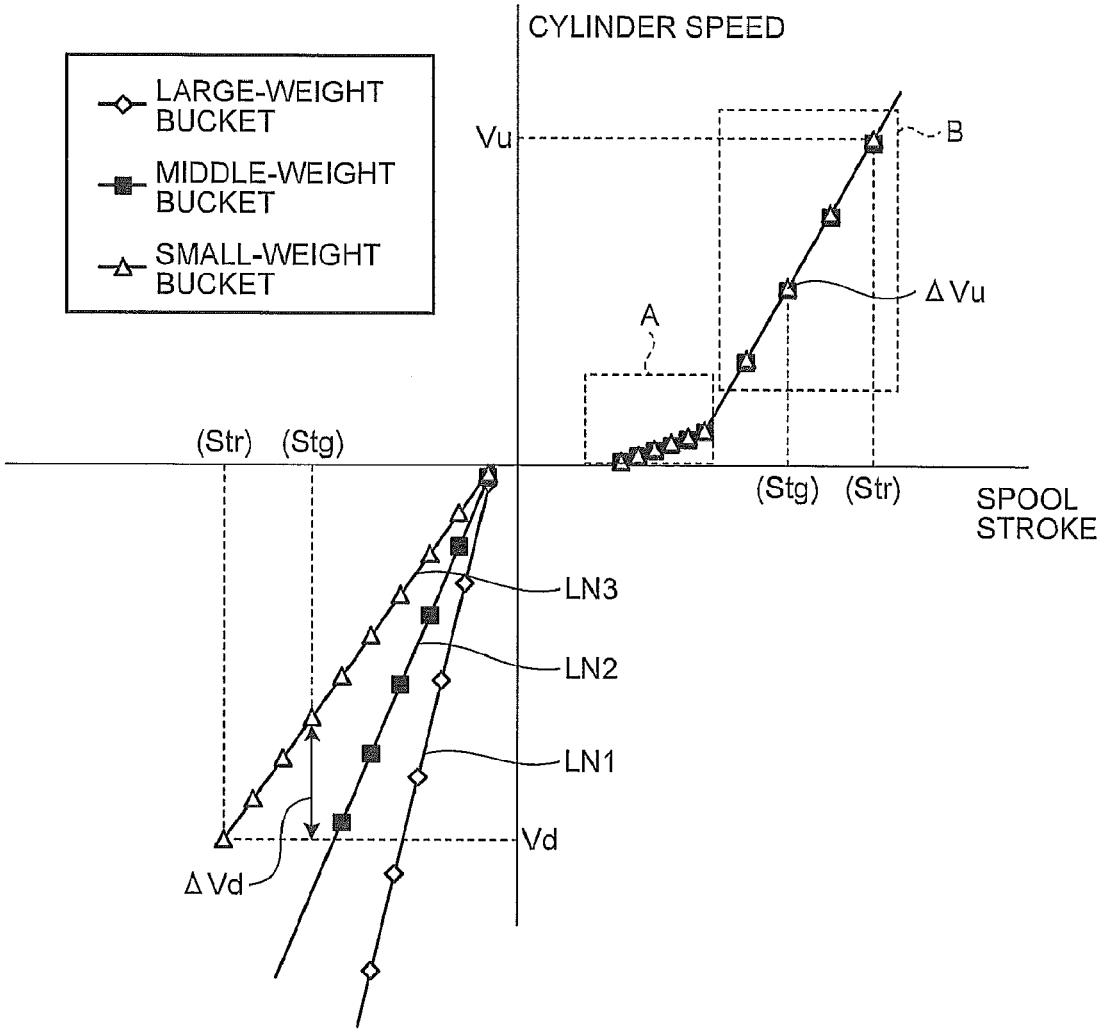
FIG. 26 is diagram illustrating the relation between a spool stroke and a cylinder speed.
Figure 27:
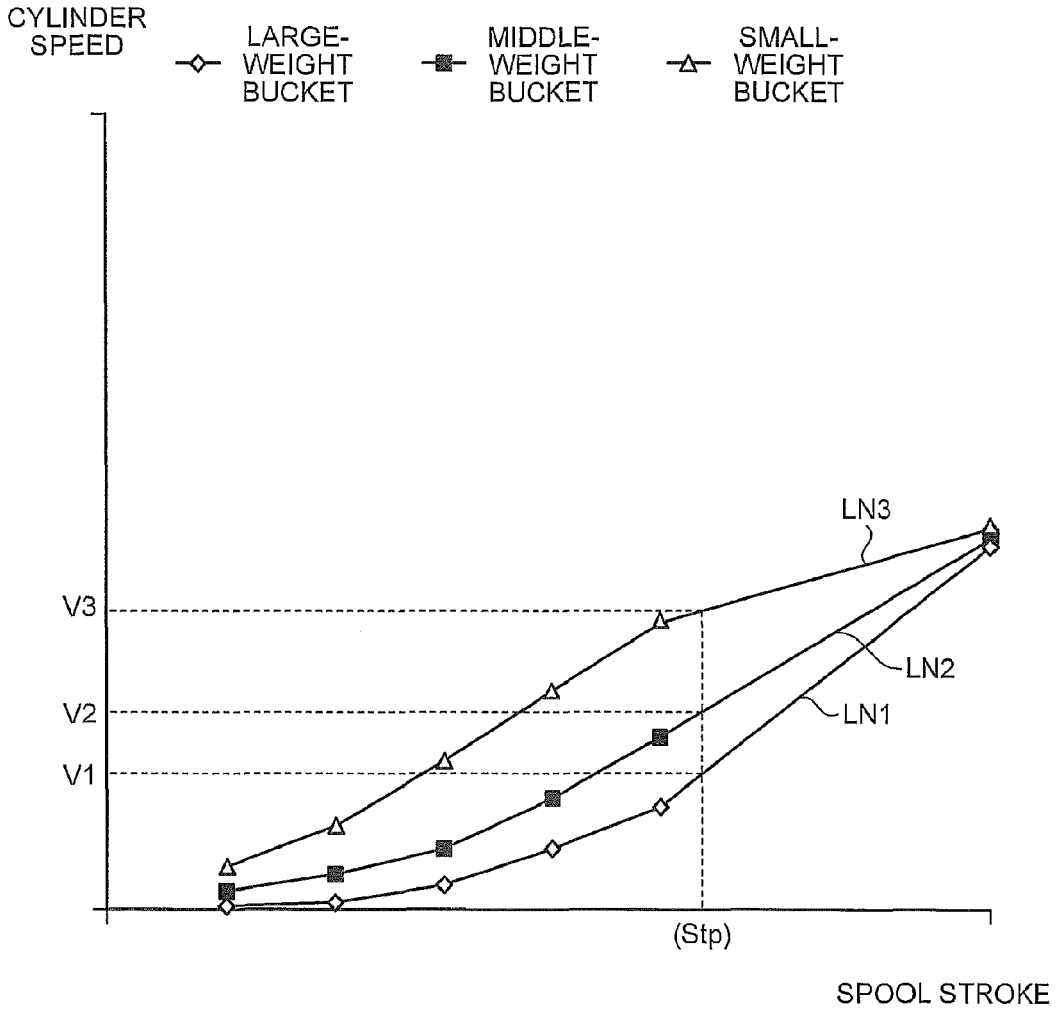
FIG. 27 is an enlarged view of a portion of FIG. 19.
Figure 28:
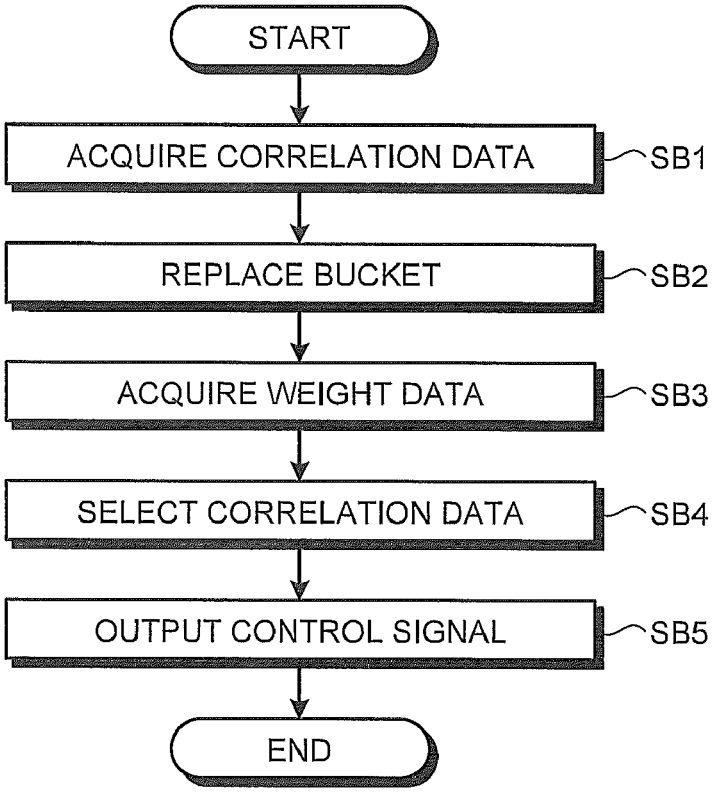
FIG. 28 is a flowchart illustrating an example of a control method.

FIG. 26 is a diagram illustrating an example of the first correlation data indicating the relation between the movement amount (spool stroke) of the spool and the cylinder speed. FIG. 27 is an enlarged view of a portion A in FIG. 26. In FIGS. 26 and 27, the horizontal axis represents the spool stroke, and the vertical axis represents the cylinder speed. A state where the spool stroke is zero (at the origin) is a state where the spool is present in the initial position. A line L1 indicates the first correlation data when the bucket 8 has a large weight. A line L2 indicates the first correlation data when the bucket 8 has a middle weight. A line L3 indicates the first correlation data when the bucket 8 has a small weight.

As illustrated in FIGS. 26 and 27, when the weight of the bucket 8 is different, the first correlation data changes according to the weight of the bucket 8.

The hydraulic cylinder 60 operates so that the raising operation and the lowering operation of the work machine 2 are executed. In FIG. 26, when the spool moves so that the spool stroke becomes positive, the work machine 2 performs the raising operation. When the spool moves so that the spool stroke becomes negative, the work machine 2 performs the lowering operation. As illustrated in FIGS. 26 and 27, the first correlation data includes the relation between the cylinder speed and the spool stroke in each of the raising operation and the lowering operation.

As illustrated in FIG. 26, the amount of change in the cylinder speed is different between the raising operation and the lowering operation of the work machine 2. That is, an amount of change Vu in the cylinder speed when the spool stroke has changed by a predetermined amount Str from the origin so that the raising operation is executed is different from an amount of change Vd in the cylinder speed when the spool stroke has changed by the predetermined amount Str from the origin so that the lowering operation is executed. In the present invention, in particular, the cylinder speed changes according to the operation command value (at least one of the movement amount of the spool 80, the PPC pressure, and the EPC current) based on the correlation data in the lowering operation. In the example illustrated in FIG. 26, when the predetermined value Str is set, the amount of change Vu is the same value for each of the large, middle, and small buckets 8, whereas the amount of change Vd (absolute value) is a different value for each of the large, middle, and small buckets 8.

The hydraulic cylinder 60 is capable of moving the work machine 2 at a high speed by the action of gravity (the weight) of the boom 6 during the lowering operation of the boom 6. On the other hand, the hydraulic cylinder 60 needs to operate while resisting against the weight of the work machine 2 during the raising operation of the boom 6. Therefore, when the amount of change in the stroke of the spool stroke is the same in the raising operation and the lowering operation, the cylinder speed during the lowering operation is higher than the cylinder speed during the raising operation. Moreover, as described above, in a case where a recycling circuit 90 is provided in the hydraulic cylinder 60, the cylinder speed further increases by the action of the recycling circuit 90 during the lowering operation of the boom 6.

As illustrated in FIG. 26, during the lowering operation of the work machine 2, as the gravity of the bucket 8 increases, the cylinder speed increases. Moreover, a difference ΔVd between the cylinder speed in relation to the middle-weight bucket 8 and the cylinder speed in relation to the small-weight bucket 8 when the spool has moved by a predetermined amount Stg from the origin during the lowering operation is larger than a difference ΔVu between the cylinder speed in relation to the middle-weight bucket 8 and the cylinder speed in relation to the small-weight bucket 8 when the spool has moved by the predetermined amount Stg from the origin during the raising operation. In the example illustrated in FIG. 26, ΔVu is approximately zero. Similarly, a difference between the cylinder speed in relation to the large-weight bucket 8 and the cylinder speed in relation to the middle-weight bucket 8 when the spool has moved by the predetermined amount Stg from the origin during the lowering operation is larger than a difference between the cylinder speed in relation to the large-weight bucket 8 and the cylinder speed in relation to the middle-weight bucket 8 when the spool has moved by the predetermined amount Stg from the origin during the raising operation.

A load acting on the hydraulic cylinder 60 is different between the raising operation and the lowering operation of the work machine 2. Moreover, the cylinder speed during the lowering operation of the work machine 2 changes greatly according to the weight of the bucket 8. The larger the weight of the bucket 8 is, the higher the cylinder speed during the lowering operation is. Moreover, in the boom 6, the larger the weight of the bucket 8 is, the larger the flow rate of the recycled oil of the recycling circuit 90 is, and thus, the higher the cylinder speed during the lowering operation of the boom is. Thus, a speed profile of the cylinder speed during the lowering operation of the boom 6 (work machine 2) changes greatly according to the weight of the bucket 8.

As illustrated in FIG. 27, with respect to the boom 6, when the hydraulic cylinder 60 is operated so that the raising operation of the work machine 2 is executed in an initial state where the cylinder speed of the hydraulic cylinder 60 is zero, an amount of change V1 in the cylinder speed from the initial state in relation to the large-weight bucket 8 is different from an amount of change V2 in the cylinder speed from the initial state in relation to the middle-weight bucket 8. In particular, the amount of change in the cylinder speed from the initial state (stopped state) in the slow-speed area is different between the large-weight bucket and the middle-weight bucket. That is, when the hydraulic cylinder 60 is operated so that the raising operation of the work machine 2 is executed from the initial state where the cylinder speed is zero, the amount of change (the amount of change from the zero-speed state) V1 in the cylinder speed in relation to the large-weight bucket 8 when the spool stroke has changed by a predetermined Stp from the origin is different from the amount of change (the amount of change from the zero-speed) V2 in the cylinder speed in relation to the middle-weight bucket 8 when the spool stroke has changed by the predetermined Stp from the origin. Similarly, when the hydraulic cylinder 60 is operated so that the raising operation of the work machine 2 is executed from the initial state where the cylinder speed of the hydraulic cylinder 60 is zero, the amount of change V2 in the cylinder speed from the initial state in relation to the middle-weight bucket 8 and an amount of change V3 in the cylinder speed from the initial state in relation to the small-weight bucket 8 are different from the amounts of change in the cylinder speed in case of the large-weight and small-weight buckets.

The slow-speed area denotes a cylinder speed area in the portion A illustrated in FIG. 26. In the portion A, the cylinder speed is a slow-speed. The speed area where the cylinder speed is higher than the cylinder speed in the portion A is a normal-speed area. The normal-speed area is a speed area higher than the slow-speed area. The slow-speed area may be referred to as a low-speed area and the normal-speed area may be referred to as a high-speed area. The slow-speed area is a speed area where the cylinder speed is lower than a predetermined speed. The normal-speed area is a speed area where the cylinder speed is equal to or higher than the predetermined speed, for example.

As illustrated in FIG. 26, the inclination of the graph in the slow-speed area is smaller than the inclination of the graph in the normal-speed area. That is, the amount of change in the cylinder speed with respect to the spool stroke value (the operation command value) in the normal-speed area is larger than that in the slow-speed area.

When the intervention control is executed, the boom cylinder 10 executes the raising operation of the boom 6 as described above. Thus, the boom cylinder 10 is controlled based on such first correlation data as illustrated in FIG. 27, whereby the bucket 8 can be moved with high accuracy based on the designed landform Ua even when the weight of the bucket 8 changes. That is, the hydraulic cylinder 60 is finely controlled even when the weight of the bucket 8 is changed during the activation of the hydraulic cylinder 60, whereby highly accurate limited excavation control is executed.

[Control Method]

Next, an example of an operation of the excavator 100 according to the present invention will be described. As described above, a plurality of pieces of first correlation data, a plurality of pieces of second correlation data, and a plurality of pieces of third correlation data are obtained according to the weight of the bucket 8 and stored in the storage unit 261 (step SB1).

After the bucket 8 is replaced (step SB2), the man machine interface 32 is operated by the operator, and the weight data indicating the weight of the bucket 8 is input to the acquiring unit 263 through the input unit 321. The acquiring unit 263 acquires the weight data (step SB3). The acquiring unit 263 outputs the weight data to the control valve control unit 262.

The control valve control unit 262 selects one piece of the first correlation data corresponding to the weight data from the plurality of pieces of the first correlation data stored in the storage unit 261 based on the weight data (step SB4). In the present invention, one piece of the correlation data corresponding to the weight data of the bucket 8 is selected among the first correlation data indicated by line LN1, the first correlation data indicated by line LN2, and the first correlation data indicated by line LN3. Similarly, the second correlation data and the third correlation data are selected.

For example, in the intervention control, the control valve control unit 262 selects the first correlation data, the second correlation data, and the third correlation data so that the hydraulic cylinder 60 moves at a target cylinder speed. (step SB5) based on the correlation data selected by the control valve control unit 262, the work machine control unit 57 determines a control command based on a command determined by the control valve control unit 262. For example, in order to perform the excavation work, when the operating device 25 is operated by the operator, the work machine control unit 57 generates a control signal and outputs the control signal to the control valve 27. In this way, the control of the work machine 2 including the movement amount of the spool is performed.

That is, the control valve control unit 262 determines the movement amount (spool stroke) of the spool 80 based on the selected first correlation data so as to obtain the target cylinder speed. The control valve control unit 262 determines the PPC pressure based on the second correlation data so as to obtain the determined spool stroke. The control valve control unit 262 determines the command value (EPC current) based on the third correlation data so as to obtain the determined PPC pressure. The work machine control unit 57 outputs the control signal to the control valve 27 based on the command value obtained by the control valve control unit 262. In this way, the hydraulic cylinder 60 is capable of operating at the target cylinder speed.

During driving of the hydraulic cylinder 60, the detection value of the cylinder stroke sensor (16 and the like) is output to the work machine controller 26. The cylinder stroke sensor (16 and the like) detects the cylinder speed. Moreover, the detection value of the spool stroke sensor 65 is output to the work machine controller 26. The spool stroke sensor 65 detects the spool stroke.

The control valve control unit 262 determines the spool stroke based on the detection value (cylinder speed) of the cylinder stroke sensor and the first correlation data so as to obtain the target cylinder speed. The control valve control unit 262 determines the PPC pressure based on the detection value (spool stroke) of the spool stroke sensor 65 and the second correlation data so as to obtain the target spool stroke. The control valve control unit 262 determines the command value (EPC current) based on the third correlation data so as to obtain the target PPC pressure.

[Effects]

As described above, according to the present embodiment, since in the intervention control (limited excavation control) of the boom 6, a plurality of pieces of first correlation data corresponding to a plurality of weights of the bucket 8, respectively, is obtained, and the first correlation data to be used is selected when the bucket 8 is replaced, and the movement amount of the spool 80 is controlled based on the selected first correlation data, a decreases in the excavation accuracy is suppressed. That is, if a change in the weight of the work machine 2 due to the replacement or the like of the bucket 8 is not taken into consideration, the hydraulic cylinder 60 may not operate so as to correspond to the EPC current output based on the initially intended amount of operation of the operating device 25, and the hydraulic cylinder 60 may be unable to execute an intended operation. In particular, in a fine operation phase for activation of the hydraulic cylinder 60, the activation of the hydraulic cylinder 60 may be delayed and in severe cases, an oscillation may occur.

According to the present embodiment, the first correlation data is used so that the hydraulic cylinder 60 operates at the target cylinder speed by taking a change in the weight of the work machine 2 into consideration. Moreover, the first correlation data finely sets the speed profile of the activation of the hydraulic cylinder 60 for executing the raising operation according to the weight of the bucket 8. In this way, it is possible to suppress a decrease in the excavation accuracy.

Moreover, according to the present embodiment, the hydraulic cylinder 60 operates so that the raising operation and the lowering operation of the work machine 2 are executed. The load acting on the hydraulic cylinder 60 changes between the raising operation and the lowering operation of the work machine 2, and the amount of change in the cylinder speed is different between the raising operation and the lowering operation. According to the present embodiment, since the first correlation data includes the relation between the cylinder speed and the spool stroke in each of the raising operation and the lowering operation, the movement amount of the spool 80 is controlled appropriately in each of the raising operation and the lowering operation and a decrease in the excavation accuracy is suppressed.

Moreover, a difference between the cylinder speed in relation to the bucket 8 having a first weight and the cylinder speed in relation to the bucket 8 having a second weight when the spool 80 has moved by a predetermined amount from the origin during the lowering operation of the work machine 2 is larger than a difference between the cylinder speed in relation to the bucket 8 having the first weight and the cylinder speed in relation to the bucket 8 having the second weight when the spool 80 has moved by the predetermined amount from the origin during the raising operation of the work machine 2. By controlling the movement amount of the spool 80 appropriately by taking the difference during the lowering operation and the difference during the raising operation into consideration, a decrease in the excavation accuracy is suppressed.

Moreover, according to the present embodiment, the hydraulic cylinder 60 operates so that the raising operation of the work machine 2 is executed in an initial state where the cylinder speed is zero, and an amount of change in the cylinder speed from the initial state in relation to the bucket 8 having the first weight is different from an amount of change in the cylinder speed from the initial state in relation to the bucket 8 having the second weight. By controlling the movement amount of the spool 80 appropriately by taking the amount of change in the cylinder speed when the raising operation is executed from the initial state due to the difference in the weight of the bucket 8 into consideration, a decrease in the excavation accuracy is suppressed.

Moreover, in the present embodiment, the work machine control unit 57 outputs the control signal to the control valve 27 based on the characteristics obtained by the control valve control unit 262. That is, in the limited excavation control, the control signal is output to the control valve 27 which is an electromagnetic proportional control valve. In this way, it is possible to adjust the pilot pressure to accurately adjust the amount of operating oil supplied to the hydraulic cylinder 60.

Moreover, in the present embodiment, the second correlation data indicating the relation between the movement amount of the spool 80 and the pilot pressure and the third correlation data indicating the pilot pressure and the control signal output from the control valve control unit 262 to the control valve 27 as well as the first correlation data indicating the relation between the cylinder speed and the movement amount of the spool 80 are obtained in advance and are stored in the storage unit 261. Thus, the control valve control unit 262 can move the hydraulic cylinder 60 at the target cylinder speed more accurately by outputting the control signal to the control valve 27 based on the first correlation data, the second correlation data, and the third correlation data.

Moreover, in the present embodiment, the recycling circuit 90 is provided to the boom cylinder 10 that drives the boom 6. The recycling circuit 90 returns a portion of the operating oil (recycled oil) from the rod side of the boom cylinder 10 to the cap side of the boom cylinder 10 by using the load pressure according to the weight of the boom 6. In this way, it is possible to increase the moving speed of the boom 6 (cylinder speed of the boom cylinder 10) during the lowering operation of the boom 6. In the boom 6, the larger the weight of the bucket 8 is, the larger the flow rate of the recycled oil of the recycling circuit 90 is, and thus, the recycling circuit 90 increases the cylinder speed. Therefore, during the lowering operation of the boom 6 (work machine 2), the speed profile of the cylinder speed changes greatly according to the weight of the bucket 8. By appropriately controlling the movement amount of the spool 80 by taking into consideration the speed profile of the cylinder speed, it is possible to suppress a decrease in the excavation accuracy while increasing the moving speed of the boom 6 during the lowering operation.

In addition, in the present invention, the example of using the first correlation data indicating the relation between the cylinder speed and the spool stroke, the second correlation data indicating the relation between the spool stroke and the PPC pressure (pilot pressure), and the third correlation data indicating the relation between the PPC pressure and the control signal (EPC current) has been described. Correlation data indicating the relation between the cylinder speed and the PPC pressure (pilot pressure) may be stored in the storage unit 261, and the work machine 2 may be controlled using the correlation data. That is, correlation data including the first correlation data combined with the second correlation data may be obtained in advance through experiments or simulation, and the PPC pressure may be controlled according to the weight of the bucket 8 based on the correlation data.

In addition, in the present embodiment, in a state where the control valve 27 is fully opened, the pressure sensors 66 and 67 may detect the pressure, and the calibration of the pressure sensors 66 and 67 may be performed based on the detection value. In the case where the control valve 27 is fully opened, the pressure sensor 66 and the pressure sensor 67 output the same detection value. In the case where the control valve 27 is fully opened, if the pressure sensor 66 and the pressure sensor 67 output different detection values, the correlation data indicating the relation between the detection value of the pressure sensor 66 and the detection value of the pressure sensor 67 may be obtained.

While the embodiment of the present invention have been described above, the present invention is not limited to the above-described embodiment and various modifications can be made without departing from the spirit of the present invention.

For example, in the above-described embodiment, the operating device 25 is a pilot pressure. The operating device 25 may be an electric lever-type operating device. For example, an operating lever detection unit such as a potentiometer which detects the amount of operation of the operating lever of the operating device 25 and outputs a voltage value corresponding to the amount of operation to the work machine controller 26 may be installed. The work machine controller 26 may output the control signal to the control valve 27 based on the detection result of the operating lever detection unit to adjust the pilot pressure. Although the control has been performed by the work machine controller, the control may be performed by another controller such as a sensor controller 30.

Although in the above-described embodiment the excavator has been described as an example of the construction machine, the present invention is not limited to the excavator, and may be applied to other types of construction machines.

The position of the excavator CM in the global coordinate system may be acquired by other position measurement means without being limited to GNSS. Thus, the distance d between the cutting edge 8*a* and the designed landform may be acquired by other position measurement means without being limited to GNSS.

REFERENCE SIGNS LIST

1 VEHICLE BODY
2 WORK MACHINE
3 SWINGING STRUCTURE
4 CAB
5 TRAVELING DEVICE
5Cr CRAWLER BELT
6 BOOM
7 ARM
8 BUCKET
9 ENGINE ROOM
10 BOOM CYLINDER
11 ARM CYLINDER
12 BUCKET CYLINDER
13 BOOM PIN
14 ARM PIN
15 BUCKET PIN
16 BOOM CYLINDER STROKE SENSOR
17 ARM CYLINDER STROKE SENSOR
18 BUCKET CYLINDER STROKE SENSOR
19 HANDRAIL
20 POSITION DETECTION DEVICE
21 ANTENNA
23 GLOBAL COORDINATE CALCULATING UNIT
24 IMU
25 OPERATING DEVICE
25L SECOND OPERATING LEVER
25R FIRST OPERATING LEVER
26 WORK MACHINE CONTROLLER
27 CONTROL VALVE
28 DISPLAY CONTROLLER
29 DISPLAY UNIT
31 BOOM OPERATION OUTPUT UNIT
32 BUCKET OPERATION OUTPUT UNIT
33 ARM OPERATION OUTPUT UNIT
34 SWINGING OPERATION OUTPUT UNIT
40A CAP-SIDE OIL CHAMBER
40B ROD-SIDE OIL CHAMBER
41 HYDRAULIC PUMP
41A SWASH PLATE
45 DELIVERED OIL PASSAGE
47 OIL PASSAGE
48 OIL PASSAGE
49 PUMP CONTROL UNIT
50 OIL PASSAGE
51 SHUTTLE VALVE
60 HYDRAULIC CYLINDER
63 SWINGING MOTOR
64 DIRECTION CONTROL VALVE
65 SPOOL STROKE SENSOR
66 PRESSURE SENSOR
67 PRESSURE SENSOR
70 DETECTION DEVICE
71 FILTER DEVICE
100 CONSTRUCTION MACHINE (EXCAVATOR)
161 ROTATION ROLLER
162 ROTATION CENTER SHAFT
163 ROTATION SENSOR PORTION
164 CASE
200 CONTROL SYSTEM
300 HYDRAULIC SYSTEM
AX SWING AXIS
Q SWINGING STRUCTURE DIRECTION DATA
S CUTTING EDGE POSITION DATA
T TARGET CONSTRUCTION SURFACE INFORMATION
U TARGET EXCAVATION LANDFORM

The invention claimed is:

1. A construction machine control system for a construction machine that includes a work machine including a boom, an arm, and a bucket and an operating device receiving an input of an operator's operation command for driving the work machine, the construction machine control system comprising:

a hydraulic cylinder that drives the work machine;

a direction control valve that has a movable spool and that supplies operating oil to the hydraulic cylinder with movement of the spool to operate the hydraulic cylinder;

a control valve that allows the spool to be movable based on the operation command;

a storage unit that stores a plurality of pieces of correlation data indicating a relation between a cylinder speed of the hydraulic cylinder and an operation command value indicating a value of an operation command signal for operating the hydraulic cylinder according to a type of the bucket;

an acquiring unit that acquires type data indicating the type of the bucket; and a control unit that selects one piece of correlation data from the plurality of pieces of correlation data based on the type data and controls the operation command value based on the selected correlation data.

2. The construction machine control system according to claim 1, wherein the hydraulic cylinder operates so that a lowering operation of the boom is executed, wherein the correlation data includes a relation between the cylinder speed of the hydraulic cylinder and the operation command value of operating the hydraulic cylinder in the lowering operation, and wherein the cylinder speed changes with respect to the operation command value based on the correlation data in the lowering operation.

3. The construction machine control system according to claim 1, wherein the hydraulic cylinder operates so that a raising operation of the work machine is executed from an initial state where the cylinder speed is zero, and wherein an amount of change in the cylinder speed from the initial state in a slow-speed area where the cylinder speed is larger than zero and equal to or smaller than a predetermined speed is different between a first type bucket and a second type bucket.

4. The construction machine control system according to claim 1, wherein the storage unit stores first correlation data indicating a relation between the cylinder speed and a movement amount of the spool, second correlation data indicating a relation between the movement amount of the spool and pressure of the pilot oil, and third correlation data indicating a relation between the pressure of the pilot oil and a control signal output from the control unit to the control valve, and wherein the control unit outputs the control signal to the control valve based on the first correlation data, the second correlation data, and the third correlation data so that the hydraulic cylinder moves at a target cylinder speed.

5. The construction machine control system according to claim 1, wherein the control valve adjusts the pressure of the pilot oil for moving the spool and allows the spool to be movable by the pilot oil, the construction machine control system further comprising:

a control valve control unit that determines a current value to be supplied to the control valve;

a pressure sensor that detects a pressure value of the pilot oil; and a spool stroke sensor that detects a movement amount value of the spool, and wherein the operation command value includes at least one of the current value, the pressure value, and the movement amount value.

6. The construction machine control system according to claim 1, further comprising a recycling circuit that returns a portion of the operating oil from a rod side of the hydraulic cylinder to a cap side of the boom cylinder by using load pressure according to weight of the work machine.

7. A construction machine comprising:

a lower traveling structure;

an upper swinging structure that is supported by the lower traveling structure;

a work machine that includes a boom, an arm, and a bucket and is supported by the upper swinging structure; and the construction machine control system according to claim 1.

8. A construction machine control method for a construction machine that includes a work machine including a boom, an arm, and a bucket and allows the work machine to be driven based on an operator's operation command, wherein the construction machine includes a hydraulic cylinder that drives the work machine, a direction control valve that has a movable spool and that supplies operating oil to the hydraulic cylinder with movement of the spool to operate the hydraulic cylinder, and a control valve that allows the spool to be movable based on the operation command, and the construction machine control method comprising:

obtaining a plurality of pieces of first correlation data indicating a relation between a cylinder speed of the hydraulic cylinder and an operation command value indicating a value of an operation command signal for operating the hydraulic cylinder according to a type of the bucket;

acquiring type data indicating the type of the bucket;

selecting one piece of correlation data from the plurality of pieces of correlation data based on the type data; and controlling a movement amount of the spool based on the selected correlation data.

* * * * *